US008994760B2

(12) United States Patent
Irie et al.

(10) Patent No.: US 8,994,760 B2
(45) Date of Patent: Mar. 31, 2015

(54) LIQUID CRYSTAL DISPLAY DEVICE AND METHOD FOR DRIVING A LIQUID CRYSTAL DISPLAY DEVICE

(75) Inventors: Kentaroh Irie, Osaka (JP); Masae Kawabata, Osaka (JP); Fumikazu Shimoshikiryoh, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 317 days.

(21) Appl. No.: 13/511,973

(22) PCT Filed: Jul. 29, 2010

(86) PCT No.: PCT/JP2010/062796
§ 371 (c)(1),
(2), (4) Date: May 24, 2012

(87) PCT Pub. No.: WO2011/065063

PCT Pub. Date: Jun. 3, 2011

(65) Prior Publication Data

US 2012/0268504 A1 Oct. 25, 2012

(30) Foreign Application Priority Data

Nov. 27, 2009 (JP) ..... 2009-270819

(51) Int. Cl.
*G09G 5/10* (2006.01)
*G09G 3/36* (2006.01)
*G09G 3/20* (2006.01)

(52) U.S. Cl.
CPC ..... *G09G 3/3614* (2013.01); *G09G 3/2077* (2013.01); *G09G 3/2011* (2013.01); (Continued)

(58) Field of Classification Search
CPC ..... G09G 2300/0823; G09G 310/0235; G09G 2310/0251; G09G 2310/0259; G09G 2320/0219; G09G 2320/0247; G09G 2320/0276; G09G 2320/028; G09G 2320/0285; G09G 2330/04; G09G 3/2011; G09G 3/2025; G09G 3/2077; G09G 3/3614
USPC ..... 345/87–89, 204, 209, 690; 349/142, 349/143
See application file for complete search history.

(56) References Cited

U.S. PATENT DOCUMENTS 5,847,688 A * 12/1998 Ohi et al. ..... 345/98
2005/0231497 A1* 10/2005 Harada ..... 345/204

FOREIGN PATENT DOCUMENTS

EP 1 564 714 8/2005
JP 5-307371 11/1993

(Continued)

OTHER PUBLICATIONS

Search Report and Written Opinion mailed Sep. 7, 2010, directed to International Application No. PCT/JP2010/0062796; 7 pages.

*Primary Examiner* — Kumar Patel
*Assistant Examiner* — Insa Sadio
(74) *Attorney, Agent, or Firm* — Morrison & Foerster LLP

(57) ABSTRACT

The present invention provides a liquid crystal display device that appropriately compensates for a feed-through voltage. The liquid crystal display device is arranged such that when data of a certain gray level is to be displayed, the effective value of a pixel voltage changes in an N-frame cycle, a first pixel and a second pixel are provided that are different in the effective value during an i-th frame ($1 \leq i \leq N$), the first pixel has a positive polarity during the i-th frame, whereas the second pixel has a negative polarity during an i{N/2 after}th frame, the first pixel has a polarity during a j-th frame (where $1 \leq j \leq N$ and $i \neq j$), the polarity being different from the polarity of the second pixel during a j{N/2 after}th frame, and when data of a first gray level is to be displayed, VB and VC are different from each other, where VA is a source voltage (VD) of the first pixel during the i-th frame, VB is a source voltage (VD) of the second pixel during the i{N/2 after}th frame, and VC is, in a case where data of a second gray level is to be displayed when the first pixel has a positive polarity during the j-th frame, a source voltage (VD) of the second pixel during the j{N/2 after}th frame for the case in which the source voltage (VD) of the first pixel during the first pixel is VA.

30 Claims, 28 Drawing Sheets

(52) U.S. Cl.
CPC ..... *G09G3/2025* (2013.01); *G09G 2320/0247* (2013.01); *G09G 2300/0823* (2013.01); *G09G 2310/0251* (2013.01); *G09G 2320/0219* (2013.01); *G09G 2320/0276* (2013.01); *G09G 2320/028* (2013.01); *G09G 2320/0285* (2013.01); *G09G 2330/04* (2013.01); *G09G 2310/0235* (2013.01); *G09G 2310/0259* (2013.01)
USPC ..... 345/690; 345/87; 345/88; 345/89; 345/204; 345/209; 349/142; 349/143

(56) References Cited

FOREIGN PATENT DOCUMENTS

| | | |
|---|---|---|
| JP | 7-121144 | 5/1995 |
| JP | 8-136897 | 5/1996 |
| JP | 2004-205896 | 7/2004 |
| JP | 2009-162955 | 7/2009 |
| WO | WO-2008/029535 | 3/2008 |

* cited by examiner

FIG. 2

| FRAME | F1 | F2 | F3 | F4 | F5 | F6 | F7 | F8 |
|---|---|---|---|---|---|---|---|---|
| γ SETTING | A+ | B+ | A− | B− | A+ | B+ | A− | B− |
| Cic | Cb | Ca | Cb | Ca | Cb | Ca | Cb | Ca |
| ACTUAL ΔVd | Vb | Va | Vb | Va | Vb | Va | Vb | Va |
| SOURCE VOLTAGE ΔVd CORRECTION | Vb | Va | Vb | Va | Vb | Va | Vb | Va |

FIG. 7

| INPUT 10bit | INPUT 8bit | A + | B + | A − | B − |
|---|---|---|---|---|---|
| 0 | 0 | 0 | 0 | 0 | 0 |
| 4 | 1 | 55 | 0 | 37 | 0 |
| 8 | 2 | 131 | 0 | 87 | 0 |
| 12 | 3 | 197 | 0 | 149 | 3 |
| 16 | 4 | 236 | 0 | 188 | 5 |
| 20 | 5 | 276 | 0 | 227 | 8 |
| 24 | 6 | 306 | 0 | 255 | 9 |
| 28 | 7 | 327 | 0 | 275 | 10 |
| 32 | 8 | 348 | 0 | 295 | 10 |
| 36 | 9 | 365 | 0 | 313 | 10 |
| 40 | 10 | 378 | 0 | 327 | 10 |
| 44 | 11 | 392 | 0 | 342 | 10 |
| 48 | 12 | 402 | 0 | 350 | 11 |
| 52 | 13 | 412 | 0 | 357 | 11 |
| 56 | 14 | 420 | 0 | 363 | 12 |
| 60 | 15 | 428 | 0 | 370 | 12 |
| 64 | 16 | 434 | 0 | 376 | 12 |
| ⋮ | ⋮ | ⋮ | ⋮ | ⋮ | ⋮ |
| 480 | 120 | 861 | 0 | 835 | 17 |
| 484 | 121 | 862 | 0 | 837 | 17 |
| 488 | 122 | 864 | 0 | 839 | 17 |
| 492 | 123 | 866 | 0 | 841 | 17 |
| 496 | 124 | 868 | 0 | 844 | 17 |
| 500 | 125 | 870 | 0 | 846 | 17 |
| 504 | 126 | 872 | 0 | 848 | 17 |
| 508 | 127 | 874 | 0 | 850 | 17 |
| 512 | 128 | 876 | 0 | 853 | 17 |
| 516 | 129 | 878 | 0 | 855 | 17 |
| 520 | 130 | 879 | 0 | 857 | 17 |
| 524 | 131 | 881 | 0 | 858 | 17 |
| 528 | 132 | 882 | 0 | 860 | 17 |
| 532 | 133 | 884 | 0 | 862 | 17 |
| 536 | 134 | 886 | 0 | 864 | 18 |
| 540 | 135 | 888 | 0 | 866 | 18 |
| 544 | 136 | 890 | 0 | 868 | 18 |
| ⋮ | ⋮ | ⋮ | ⋮ | ⋮ | ⋮ |
| 980 | 245 | 1023 | 867 | 1023 | 882 |
| 984 | 246 | 1023 | 880 | 1023 | 892 |
| 988 | 247 | 1023 | 893 | 1023 | 904 |
| 992 | 248 | 1023 | 906 | 1023 | 916 |
| 996 | 249 | 1023 | 920 | 1023 | 929 |
| 1000 | 250 | 1023 | 934 | 1023 | 943 |
| 1004 | 251 | 1023 | 949 | 1023 | 957 |
| 1008 | 252 | 1023 | 965 | 1023 | 972 |
| 1012 | 253 | 1023 | 981 | 1023 | 986 |
| 1016 | 254 | 1023 | 1000 | 1023 | 1003 |
| 1023 | 255 | 1023 | 1023 | 1023 | 1023 |

FIG. 11

| FRAME | F1 | F2 | F3 | F4 | F5 | F6 | F7 | F8 |
|---|---|---|---|---|---|---|---|---|
| γ SETTING (POSITIVE POLARITY) | A1+ | A2− | B1+ | B2− | A1+ | A2− | B1+ | B2− |
| γ SETTING (NEGATIVE POLARITY) | A1− | A2+ | B1− | B2+ | A1− | A2+ | B1− | B2+ |
| Clc | Cb2 | Ca1 | Ca2 | Cb1 | Cb2 | Ca1 | Ca2 | Cb1 |
| ACTUAL ΔVd | Vb2 | Va1 | Va2 | Vb1 | Vb2 | Va1 | Va2 | Vb1 |
| SOURCE VOLTAGE ΔVd CORRECTION | Vb2 | Va1 | Va2 | Vb1 | Vb2 | Va1 | Va2 | Vb1 |

FIG. 17

| INPUT 10bit | INPUT 8bit | C + | A − | D + | B − | C − | A + | D − | B + |
|---|---|---|---|---|---|---|---|---|---|
| 0 | 0 | 0 | 0 | 0 | 0 | 0 | 0 | 0 | 0 |
| 4 | 1 | 55 | 14 | 0 | 9 | 37 | 14 | 0 | 8 |
| 8 | 2 | 131 | 34 | 0 | 19 | 87 | 34 | 0 | 19 |
| 12 | 3 | 197 | 42 | 0 | 25 | 149 | 42 | 3 | 25 |
| 16 | 4 | 236 | 47 | 0 | 29 | 188 | 47 | 5 | 28 |
| 20 | 5 | 276 | 52 | 0 | 32 | 227 | 52 | 8 | 32 |
| 24 | 6 | 306 | 57 | 0 | 32 | 255 | 57 | 9 | 32 |
| 28 | 7 | 327 | 61 | 0 | 32 | 275 | 61 | 10 | 32 |
| 32 | 8 | 348 | 66 | 0 | 32 | 295 | 66 | 10 | 32 |
| 36 | 9 | 365 | 71 | 0 | 32 | 313 | 71 | 10 | 32 |
| 40 | 10 | 378 | 75 | 0 | 32 | 327 | 75 | 10 | 32 |
| 44 | 11 | 392 | 80 | 0 | 32 | 342 | 80 | 10 | 32 |
| 48 | 12 | 402 | 85 | 0 | 32 | 350 | 85 | 11 | 32 |
| 52 | 13 | 412 | 90 | 0 | 32 | 357 | 90 | 11 | 32 |
| 56 | 14 | 420 | 94 | 0 | 32 | 363 | 94 | 12 | 32 |
| 60 | 15 | 428 | 98 | 0 | 32 | 370 | 98 | 12 | 32 |
| 64 | 16 | 434 | 104 | 0 | 32 | 376 | 104 | 12 | 32 |
| ⋮ | ⋮ | ⋮ | ⋮ | ⋮ | ⋮ | ⋮ | ⋮ | ⋮ | ⋮ |
| 480 | 120 | 861 | 694 | 0 | 63 | 835 | 694 | 17 | 63 |
| 484 | 121 | 862 | 698 | 0 | 64 | 837 | 698 | 17 | 64 |
| 488 | 122 | 864 | 702 | 0 | 65 | 839 | 702 | 17 | 65 |
| 492 | 123 | 866 | 706 | 0 | 67 | 841 | 706 | 17 | 67 |
| 496 | 124 | 868 | 711 | 0 | 68 | 844 | 711 | 17 | 68 |
| 500 | 125 | 870 | 715 | 0 | 69 | 846 | 715 | 17 | 69 |
| 504 | 126 | 872 | 719 | 0 | 70 | 848 | 719 | 17 | 70 |
| 508 | 127 | 874 | 722 | 0 | 72 | 850 | 722 | 17 | 72 |
| 512 | 128 | 876 | 726 | 0 | 73 | 853 | 726 | 17 | 73 |
| 516 | 129 | 878 | 731 | 0 | 75 | 855 | 731 | 17 | 75 |
| 520 | 130 | 879 | 736 | 0 | 76 | 857 | 736 | 17 | 76 |
| 524 | 131 | 881 | 740 | 0 | 78 | 858 | 740 | 17 | 78 |
| 528 | 132 | 882 | 745 | 0 | 79 | 860 | 745 | 17 | 79 |
| 532 | 133 | 884 | 749 | 0 | 81 | 862 | 749 | 17 | 81 |
| 536 | 134 | 886 | 753 | 0 | 83 | 864 | 753 | 18 | 83 |
| 540 | 135 | 888 | 757 | 0 | 84 | 866 | 757 | 18 | 84 |
| 544 | 136 | 890 | 761 | 0 | 86 | 868 | 761 | 18 | 86 |
| ⋮ | ⋮ | ⋮ | ⋮ | ⋮ | ⋮ | ⋮ | ⋮ | ⋮ | ⋮ |
| 980 | 245 | 1023 | 1013 | 867 | 894 | 1023 | 1013 | 882 | 894 |
| 984 | 246 | 1023 | 1014 | 880 | 903 | 1023 | 1014 | 892 | 903 |
| 988 | 247 | 1023 | 1014 | 893 | 914 | 1023 | 1014 | 904 | 914 |
| 992 | 248 | 1023 | 1015 | 906 | 924 | 1023 | 1015 | 916 | 924 |
| 996 | 249 | 1023 | 1015 | 920 | 935 | 1023 | 1015 | 929 | 935 |
| 1000 | 250 | 1023 | 1015 | 934 | 946 | 1023 | 1015 | 943 | 946 |
| 1004 | 251 | 1023 | 1016 | 949 | 958 | 1023 | 1016 | 957 | 958 |
| 1008 | 252 | 1023 | 1017 | 965 | 971 | 1023 | 1017 | 972 | 971 |
| 1012 | 253 | 1023 | 1019 | 981 | 985 | 1023 | 1019 | 986 | 985 |
| 1016 | 254 | 1023 | 1021 | 1000 | 1003 | 1023 | 1021 | 1003 | 1003 |
| 1023 | 255 | 1023 | 1023 | 1023 | 1023 | 1023 | 1023 | 1023 | 1023 |

FIG. 19

| INPUT 10bit | INPUT 8bit | C + | A − | D + | B − | C − | A + | D − | B + |
|---|---|---|---|---|---|---|---|---|---|
| 0 | 0 | 0 | 0 | 0 | 0 | 0 | 0 | 0 | 0 |
| 4 | 1 | 22 | 21 | 17 | 16 | 21 | 21 | 18 | 16 |
| 8 | 2 | 28 | 27 | 22 | 21 | 27 | 27 | 23 | 20 |
| 12 | 3 | 38 | 37 | 31 | 29 | 38 | 37 | 32 | 28 |
| 16 | 4 | 50 | 47 | 35 | 32 | 47 | 49 | 37 | 31 |
| 20 | 5 | 65 | 59 | 36 | 32 | 57 | 65 | 37 | 31 |
| 24 | 6 | 79 | 70 | 37 | 32 | 68 | 81 | 38 | 30 |
| 28 | 7 | 95 | 81 | 38 | 32 | 81 | 93 | 38 | 30 |
| 32 | 8 | 114 | 91 | 38 | 32 | 95 | 105 | 40 | 30 |
| 36 | 9 | 129 | 100 | 39 | 32 | 108 | 114 | 40 | 30 |
| 40 | 10 | 143 | 108 | 40 | 32 | 119 | 124 | 41 | 30 |
| 44 | 11 | 156 | 115 | 40 | 32 | 128 | 131 | 42 | 30 |
| 48 | 12 | 168 | 122 | 41 | 32 | 140 | 139 | 43 | 30 |
| 52 | 13 | 179 | 128 | 41 | 32 | 148 | 146 | 43 | 30 |
| 56 | 14 | 190 | 134 | 42 | 32 | 158 | 153 | 44 | 30 |
| 60 | 15 | 197 | 140 | 43 | 32 | 163 | 160 | 45 | 30 |
| 64 | 16 | 205 | 147 | 43 | 32 | 169 | 167 | 46 | 30 |
| ⋮ | ⋮ | ⋮ | ⋮ | ⋮ | ⋮ | ⋮ | ⋮ | ⋮ | ⋮ |
| 480 | 120 | 628 | 747 | 379 | 80 | 570 | 773 | 424 | 48 |
| 484 | 121 | 633 | 751 | 384 | 82 | 576 | 776 | 428 | 49 |
| 488 | 122 | 639 | 754 | 388 | 83 | 582 | 778 | 431 | 49 |
| 492 | 123 | 644 | 757 | 393 | 84 | 587 | 780 | 435 | 49 |
| 496 | 124 | 649 | 760 | 398 | 86 | 592 | 783 | 438 | 50 |
| 500 | 125 | 654 | 763 | 403 | 87 | 598 | 786 | 441 | 51 |
| 504 | 126 | 660 | 767 | 407 | 88 | 604 | 789 | 445 | 52 |
| 508 | 127 | 665 | 769 | 411 | 89 | 610 | 791 | 447 | 53 |
| 512 | 128 | 670 | 772 | 414 | 91 | 617 | 793 | 450 | 53 |
| 516 | 129 | 675 | 775 | 417 | 92 | 624 | 796 | 453 | 54 |
| 520 | 130 | 680 | 778 | 421 | 94 | 630 | 798 | 456 | 54 |
| 524 | 131 | 686 | 780 | 424 | 95 | 637 | 801 | 459 | 55 |
| 528 | 132 | 692 | 782 | 428 | 96 | 644 | 803 | 461 | 55 |
| 532 | 133 | 696 | 785 | 431 | 97 | 650 | 805 | 464 | 56 |
| 536 | 134 | 701 | 787 | 434 | 98 | 656 | 807 | 466 | 56 |
| 540 | 135 | 706 | 790 | 437 | 100 | 662 | 809 | 469 | 56 |
| 544 | 136 | 710 | 793 | 438 | 101 | 668 | 812 | 471 | 56 |
| ⋮ | ⋮ | ⋮ | ⋮ | ⋮ | ⋮ | ⋮ | ⋮ | ⋮ | ⋮ |
| 980 | 245 | 951 | 1013 | 936 | 890 | 952 | 1014 | 943 | 881 |
| 984 | 246 | 956 | 1014 | 943 | 900 | 958 | 1015 | 950 | 891 |
| 988 | 247 | 961 | 1014 | 951 | 910 | 963 | 1015 | 957 | 902 |
| 992 | 248 | 967 | 1015 | 959 | 922 | 969 | 1016 | 964 | 914 |
| 996 | 249 | 974 | 1016 | 966 | 934 | 975 | 1017 | 971 | 927 |
| 1000 | 250 | 980 | 1017 | 974 | 946 | 981 | 1019 | 979 | 939 |
| 1004 | 251 | 986 | 1018 | 982 | 959 | 987 | 1020 | 986 | 952 |
| 1008 | 252 | 993 | 1019 | 991 | 972 | 994 | 1020 | 994 | 967 |
| 1012 | 253 | 1002 | 1019 | 1000 | 987 | 1002 | 1020 | 1002 | 984 |
| 1016 | 254 | 1011 | 1019 | 1010 | 1002 | 1011 | 1020 | 1011 | 1000 |
| 1023 | 255 | 1020 | 1020 | 1020 | 1020 | 1020 | 1020 | 1020 | 1020 |

FIG. 29

| FRAME | F1 | F2 | F3 | F4 | F5 | F6 | F7 | F8 |
|---|---|---|---|---|---|---|---|---|
| γ SETTING (POSITIVE POLARITY) | A | A | B | B | A | A | B | B |
| γ SETTING (NEGATIVE POLARITY) | A | A | B | B | A | A | B | B |
| Clc | Cb2 | Ca1 | Ca2 | Cb1 | Cb2 | Ca1 | Ca2 | Cb1 |
| ACTUAL ΔVd | Vb2 | Va1 | Va2 | Vb1 | Vb2 | Va1 | Va2 | Vb1 |
| SOURCE VOLTAGE ΔVd CORRECTION | Va | Va | Vb | Vb | Va | Va | Vb | Vb |

LIQUID CRYSTAL DISPLAY DEVICE AND METHOD FOR DRIVING A LIQUID CRYSTAL DISPLAY DEVICE

REFERENCE TO RELATED APPLICATIONS

This application is a national stage application under 35 USC 371 of International Application No. PCT/JP2010/062796, filed Jul. 29, 2010, which claims priority from Japanese Patent Application No. 2009-270819, filed Nov. 27, 2009, the entire contents of which are incorporated herein by reference.

FIELD OF THE INVENTION

The present invention relates to a liquid crystal display device that displays a halftone with use of a temporal luminance change.

BACKGROUND OF THE INVENTION

There has been proposed a technique for improving the viewing angle characteristic of a liquid crystal display device by displaying an input gray level a plurality of times while switching the γ characteristic. Patent Literature 1, for example, discloses a technique by which, with respect to a single input gray level (halftone), a bright display with a relatively high luminance is carried out twice and a dark display with a relatively low luminance is carried out twice.

The following describes such a display method with reference to FIG. 27. FIG. 27 illustrates a state in which a pixel changes its luminance through a cycle of four frames, namely from a first frame Fn through to a fourth frame Fn+3. "A" represents an input gray level corresponding to a bright display, whereas "B" represents an input gray level corresponding to a dark display. "+" represents a positive write polarity, whereas "−" represents a negative write polarity.

Specifically, the above technique switches between a bright display and a dark display by, for example, using as a single picture element the three pixels of a R (red) pixel, a G (green) pixel, and a B (blue) pixel arranged in a row direction (that is, a lateral direction). The technique carries out, (i) for the three pixels included in a picture element, a bright display during the first frame Fn, a bright display during the following second frame Fn+1, a dark display during the following third frame Fn+2, and a dark display during the following fourth frame Fn+3, and (ii) for a picture element adjacent to the above picture element, a dark display during the first frame Fn, a dark display during the following second frame Fn+1, a bright display during the following third frame Fn+2, and a bright display during the following fourth frame Fn+3. This technique displays a single input gray level (halftone) with use of two different kinds of display (that is, a bright display and a dark display) having respective luminances, and thus provides an improved viewing angle characteristic.

Japanese Patent Application Publication, Tokukaihei, No. 7-121144 A (Publication Date: May 12, 1995)

SUMMARY OF INVENTION

FIG. 28 illustrates respective changes in (i) individual voltage waveforms (namely, respective waveforms of a source voltage VD, a liquid crystal effective voltage Vcl(rms), a gate voltage Vg, a feed-through voltage ΔVd, and a drain voltage Vd), (ii) a luminance Y, and (iii) a liquid crystal capacitance Clc, all in a display according to the method of FIG. 27. FIG. 29 tabulates the details of the display drive illustrated in FIG. 28. The input gray levels A and B each have a positive write polarity and a negative write polarity, and are each equal in gray level of its write polarity. There occurs, however, a feed-through phenomenon at the end of writing the source voltage VD to a pixel. The display drive thus carries out a correction to compensate for the feed-through voltage ΔVd, and this compensation is included as a positive shift in the source voltage VD, which is then supplied to a pixel (see FIGS. 28 and 29). This arrangement causes the difference between the source voltage VD and the common voltage Vcom to be different between the positive write polarity and the negative write polarity for an identical input gray level as illustrated in FIG. 28.

The feed-through voltage ΔVd can be represented by $$\Delta Vd = Cgd/(Clc+Cs+Cgd+Csd)\times(VgH-VgL) \quad (1),$$

where Cgd is a parasitic capacitance between the gate and drain, Ccs is an auxiliary capacitance, Csd is a parasitic capacitance between the source and drain, VgH is a gate high voltage, and VgL is a gate low voltage.

The above parasitic capacitances are each defined by the pixel configuration illustrated in FIG. 30.

In FIG. 30, a pixel is provided at the intersection of a gate line GL with a source line SL, and includes a TFT 21, a liquid crystal capacitance Clc, and an auxiliary capacitance Cs. The TFT 21 includes a gate connected to the gate line GL, a source connected to the source line SL, and a drain connected to a pixel electrode. The liquid crystal capacitance Clc is formed with a liquid crystal layer sandwiched between the pixel electrode and a common electrode. The auxiliary capacitance Cs is formed with an insulating layer sandwiched between the pixel electrode and an auxiliary capacitor line. The common electrode receives a common voltage Vcom applied thereto. The auxiliary capacitor line receives an auxiliary capacitor voltage Vcs applied thereto. The TFT 21 includes a parasitic capacitance Cgd as a capacitance between the gate and drain, and a parasitic capacitance Csd as a capacitance between the source and drain.

The feed-through voltage ΔVd represented by the above formula (1) depends on the value of the liquid crystal capacitance Clc. The liquid crystal capacitance Clc, as illustrated in FIG. 28, changes in correspondence with the state of response of liquid crystal molecules. FIG. 28 illustrates, as an example, how the liquid crystal capacitance Clc changes in the case of a normally black display. The liquid crystal capacitance Clc increases as the liquid crystal molecules tilt in such a direction as to increase the transmittance (that is, increase the luminance Y). Writing of the source voltage Vd to a pixel ends when the pulse of the gate voltage Vg falls, at which point in time a feed-through phenomenon occurs. This indicates that a feed-through phenomenon occurs immediately after the liquid crystal capacitance Clc starts responding.

The gate remains ON for a period of several μ seconds to several tens of μ seconds, during which period the TFT is set to the ON state, thus connecting the pixel electrode to a source bus line and applying a predetermined voltage to the liquid crystal layer. The liquid crystal molecules cannot, however, respond during the gate ON period because of lack of sufficient time. The liquid crystal capacitance at the fall of the gate voltage is presumed to be substantially in a state achieved during the immediately preceding frame.

The above description indicates that the feed-through voltage ΔVd presumably depends, as illustrated in FIGS. 27 and 28, on the value of the liquid crystal capacitance Clc, which substantially depends on the final state of liquid crystal molecules, the final state being achieved during the immediately preceding frame.

If, however, the amount of compensation for the feed-through voltage ΔVd, which amount is to be included in the source voltage VD, is determined on the basis of display data to be written for a corresponding frame, the amount of compensation for the feed-through voltage ΔVd with respect to (i) a frame with which a bright display starts and (ii) a frame with which a dark display starts tends to be different from an appropriate amount as illustrated in FIGS. 28 and 29.

Compensating for the feed-through voltage ΔVd on the basis of display data for a corresponding frame thus raises the following problems:

(a) Data correction may be large or small for an equal gray level.

(b) Positive-polarity data and negative-polarity data for an equal gray level are different from each other in the liquid crystal effective voltage.

The problem of (a) above causes the voltage applied to liquid crystal to be shifted from an optimum counter voltage, and thus causes a flicker. The problem of (b) above, which causes the liquid crystal effective voltage to be different between the opposite polarities, makes it impossible to cancel a DC component, included in the voltage applied to liquid crystal, with an AC drive, thus causing such a DC component to induce a phenomenon, such as a screen burn-in, that decreases reliability.

The present invention has been accomplished in view of the above problems with conventional art. It is an object of the present invention to provide (i) a liquid crystal display device and (ii) a method for driving a liquid crystal display device each of which carries out a display with use of a temporal change in luminance of pixels and appropriately compensates for a feed-through voltage ΔVd.

In order to solve the above problem, a liquid crystal display device of the present invention is a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided that are different from each other in the effective value of the pixel voltage during an i-th frame (where i is a predetermined integer that satisfies $1 \leq i \leq N$) among the N frames, the pixel voltage of the first pixel has a positive polarity during the i-th frame, the pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

In order to solve the above problems, a liquid crystal display device of the present invention is a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, each as the pixel, that are different from each other in the luminance during an i-th frame (where i is a predetermined integer that satisfies $1 \leq i \leq N$) among the N frames, a pixel voltage of the first pixel has a positive polarity during the i-th frame, a pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

In order to solve the above problems, a liquid crystal display device of the present invention is a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided, the pixel voltage of the first pixel has a positive polarity during an i-th frame (where i is a predetermined integer that satisfies $1 \leq j \leq N$), and the pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

In order to solve the above problems, a liquid crystal display device of the present invention is a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, a pixel voltage of the first pixel has a positive polarity during an i-th frame (where i is a predetermined integer that satisfies $1 \leq i \leq N$), and a pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

In order to solve the above problems, a method of the present invention for driving a liquid crystal display device is a method for driving a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided that are different from each other in the effective value of the pixel voltage during an i-th frame (where i is a predetermined integer that satisfies $1 \leq i \leq N$) among the N frames, the pixel voltage of the first pixel has a positive polarity during the i-th frame, the pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage ΔVd.

In order to solve the above problems, a method of the present invention for driving a liquid crystal display device is a method for driving a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, each as the pixel, that are different from each other in the luminance during an i-th frame (where i is a predetermined integer that satisfies $1 \leq i \leq N$) among the N frames, a pixel voltage of the first pixel has a positive polarity during the i-th frame, a pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both 1 $j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage ΔVd.

In order to solve the above problems, a method of the present invention for driving a liquid crystal display device is a method for driving a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided, the pixel voltage of the first pixel has a positive polarity during an i-th frame (where i is a predetermined integer that satisfies $1 \leq i \leq N$), and the pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage ΔVd.

In order to solve the above problems, a method of the present invention for driving a liquid crystal display device is a method for driving a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, a pixel voltage of the first pixel has a positive polarity during an i-th frame (where i is a predetermined integer that satisfies $1 \leq i \leq N$), and a pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage ΔVd.

As described above, a liquid crystal display device of the present invention is a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided that are different from each other in the effective value of the pixel voltage during an i-th frame (where i is a predetermined integer that satisfies $1 \leq i \leq N$) among the N frames, the pixel voltage of the first pixel has a positive polarity during the i-th frame, the pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

The above arrangement, as a result, makes it possible to advantageously provide a liquid crystal display device that carries out a display with use of a temporal change in luminance of pixels and that appropriately compensates for a feed-through voltage ΔVd.

As described above, a method of the present invention for driving a liquid crystal display device is a method for driving a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided that are different from each other in the effective value of the pixel voltage during an i-th frame (where i is a predetermined integer that satisfies $1 \leq i \leq N$) among the N frames, the pixel voltage of the first pixel has a positive polarity during the i-th frame, the pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

The above arrangement, as a result, makes it possible to advantageously provide a method for driving a liquid crystal display device which method carries out a display with use of a temporal change in luminance of pixels and appropriately compensates for a feed-through voltage ΔVd.

BRIEF DESCRIPTION OF DRAWINGS

FIG. 2 is a table summarizing a characteristic of the operation of FIG. 1.

FIG. 7 is a lookup table corresponding to the gamma curves of FIG. 6.

FIG. 11 is a table summarizing a characteristic of the operation of each of FIGS. 9 and 10.

FIG. 17 is a lookup table corresponding to the gamma curves of FIG. 16.

FIG. 19 is a lookup table corresponding to the gamma curves of FIG. 18.

FIG. 29 is a table summarizing a characteristic of the operation of FIG. 28.

DETAILED DESCRIPTION OF THE INVENTION

An embodiment of the present invention is described below with reference to FIGS. 1 through 30.

Figure 25:
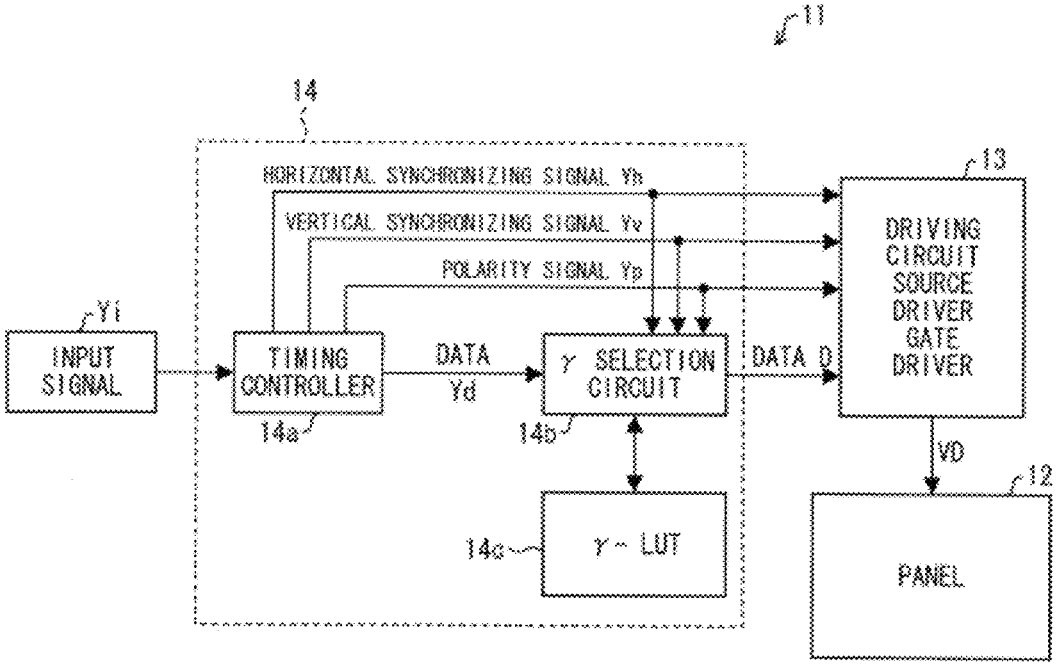
FIG. 25 is a block diagram illustrating a configuration of a display device in accordance with an embodiment of the present invention.
Figure 26:
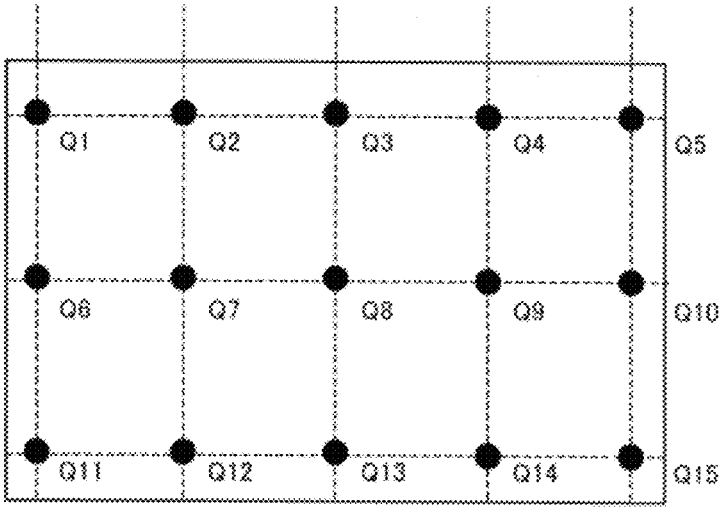
FIG. 26 is a diagram illustrating, in accordance with an embodiment of the present invention, use of a gamma curve corresponding to a pixel position on a panel.
Figure 27:
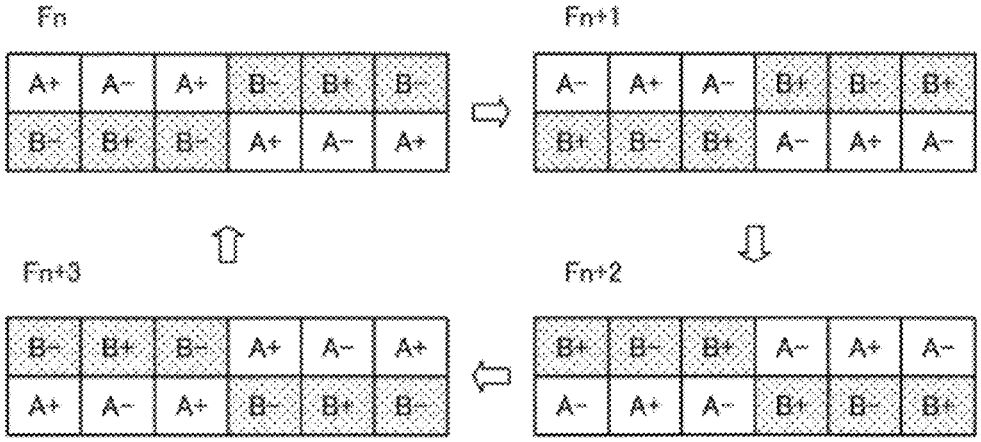
FIG. 27 is a diagram illustrating a luminance change pattern in accordance with conventional art.
Figure 28:
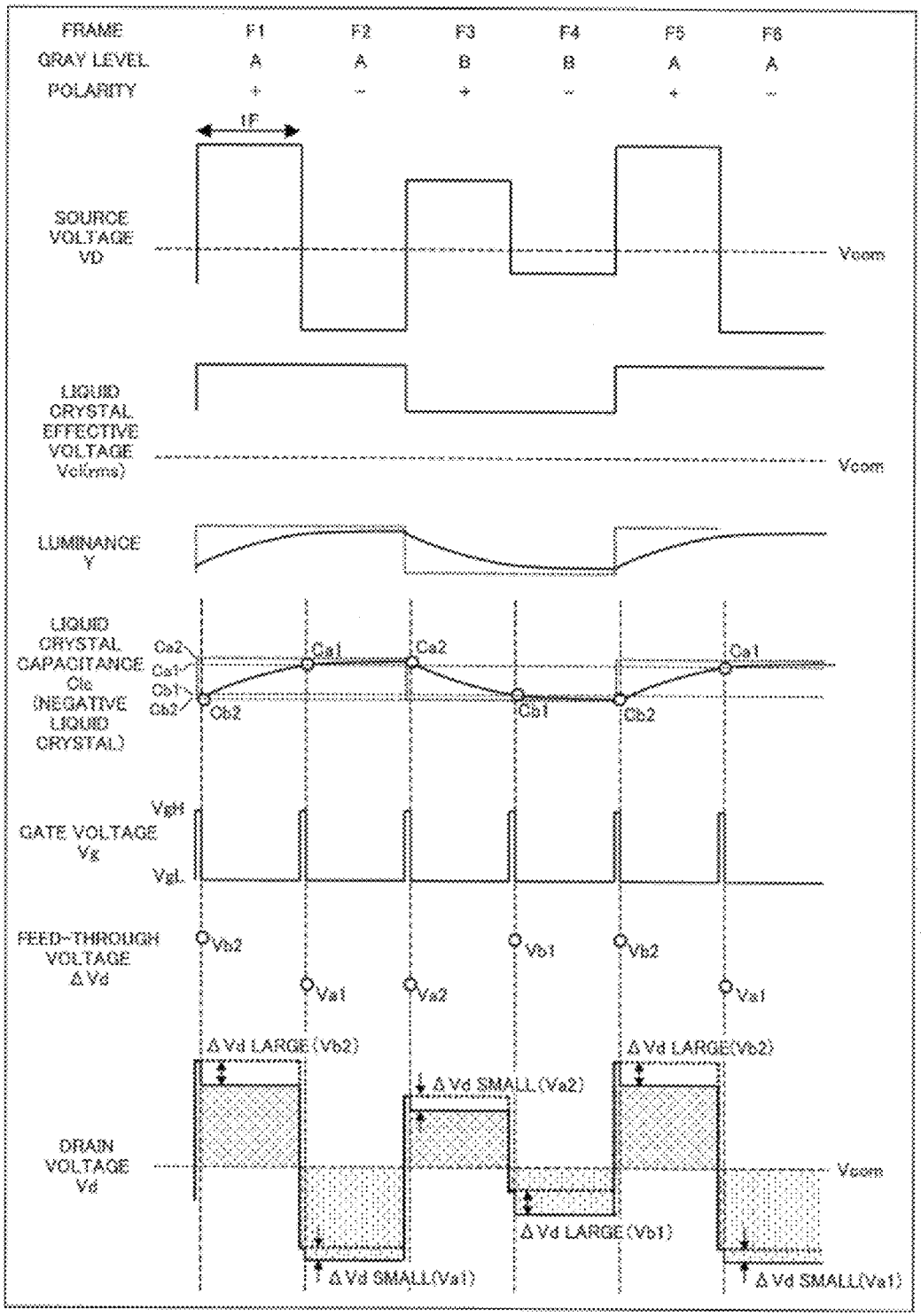
FIG. 28 is a waveform chart illustrating an operation for the luminance change in FIG. 27.
Figure 30:
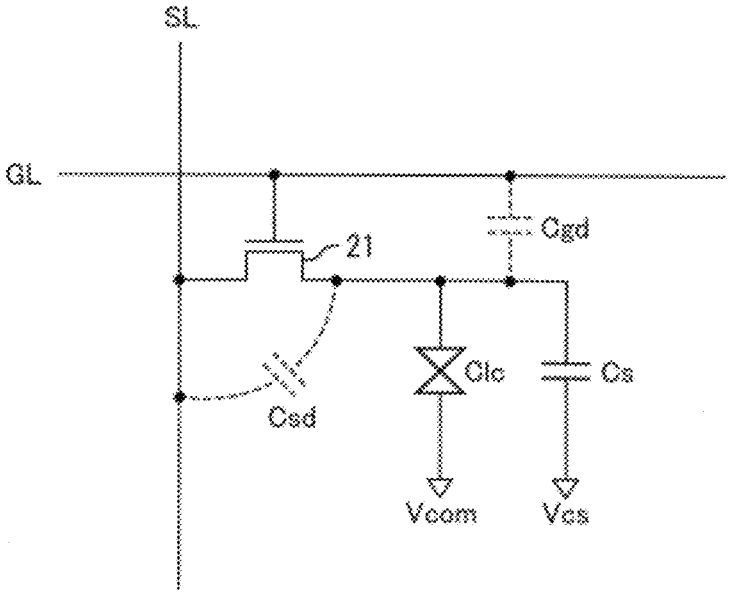
FIG. 30 is a circuit diagram illustrating, in accordance with conventional art, a configuration of a pixel including a parasitic capacitance.

FIG. 25 illustrates a configuration of a liquid crystal display device 11 of the present embodiment.

The liquid crystal display device 11 includes: a display panel 12; a driving circuit 13; and a display control circuit 14. The display control circuit 14 includes: a timing controller 14*a*; a γ selection circuit 14*b*; and a γ-LUT (gamma curve) 14*c*.

The timing controller 14*a*, upon receipt of an input signal Yi, retrieves data Yd, a horizontal synchronizing signal Yh, a vertical synchronizing signal Yv, and a polarity signal Yp from the input signal (gray scale data) Yi. The data Yd is supplied to the γ selection circuit 14*b*. The γ selection circuit 14*b* refers to the γ-LUT 14*c* stored in a memory. The γ-LUT 14*c* includes a plurality of lookup tables (gamma curves) as described below.

The γ selection circuit 14*b* selects from the γ-LUT 14*c* a lookup table for use, and switches to the selected lookup table. The γ selection circuit then (i) carries out a γ conversion of the data Yd, that is, input gray level data, into output gray scale data with reference to the selected lookup table, and (ii) supplies the thus obtained data D to the driving circuit 13.

The horizontal synchronizing signal Yh, the vertical synchronizing signal Yv, and the polarity signal Yp are used as timing signals for the γ selection circuit 14*b* and the driving circuit 13.

The driving circuit 13 includes a source driver, which converts the data D into a source voltage (data signal) VD and which supplies the source voltage VD to the display panel 12 in synchronization with a pixel scan by a gate driver included in the driving circuit 13. The display panel 12 is an active matrix display panel.

The following describes the operation of the liquid crystal display device 11 with reference to Examples.

EXAMPLE 1

Figure 1:
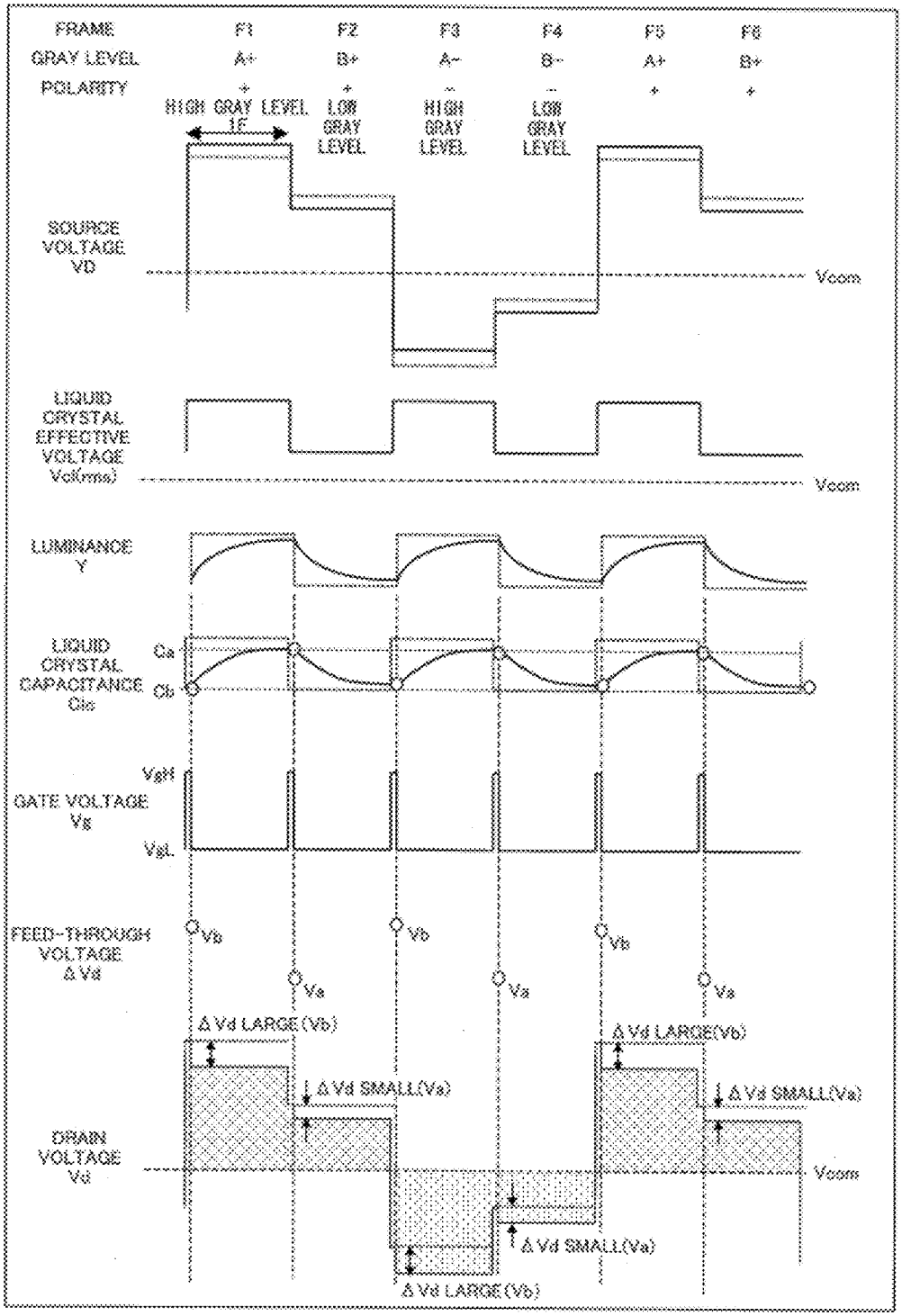
FIG. 1 is a waveform chart illustrating a first operation of a liquid crystal display device in accordance with an embodiment of the present invention.

FIG. 1 illustrates respective changes in (i) individual waveforms (namely, respective waveforms of a source voltage VD, a liquid crystal effective voltage Vcl(rms), a gate voltage Vg, a feed-through voltage ΔVd, and a drain voltage Vd), (ii) a luminance Y, and (iii) a liquid crystal capacitance Clc, the changes indicating an example operation of the liquid crystal display device 11.

The above waveforms are obtained for the case of, with use of the configuration of FIG. 25, carrying out a display by continuously inputting certain constant gray scale data as the input signal Yi. In the present embodiment, gray scale data that can be such constant gray scale data indicative of a waveform of FIG. 1 has a gray level indicative of a halftone for which the viewing angle characteristic is to be improved, and is determined for data Yd serving as input gray level data for a lookup table. The gray scale data that can be the above constant gray scale data may (i) be all or part of gray levels indicative of a halftone or may (ii) include a gray level (that is, black and white) indicative of no halftone of the data Yd.

In the case where constant gray scale data is continuously inputted as described above, a γ conversion with reference to the γ-LUT 14*c* in the display control circuit 14 causes source voltages VD corresponding to two respective gray levels, namely a gray level A and a gray level B, to be alternately supplied to a single pixel frame by frame (1F) as illustrated in FIG. 1. Of two consecutive frames, the first frame (in FIG. 1, F1, F3, or F5) involves a supply of a source voltage of the gray level A, whereas the second frame (in FIG. 1, F2, F4, or F6) involves a supply of a source voltage of the gray level B, the two frames being repeated in a cycle. The gray level A is higher than the gray level B. The description below deals with, as an example, a liquid crystal display device that carries out a normally black display. The gray level A is a level that increases luminance more than the gray level B.

The liquid crystal display device 11 is subjected to an AC drive. The gray levels A and B each have a positive polarity and a negative polarity. FIG. 1 shows (i) A+, indicative of a positive-polarity gray level A, (ii) A−, indicative of a negative-polarity gray level A, (iii) B+, indicative of a positive-polarity gray level B, and (iv) B−, indicative of a negative-polarity gray level B. The gray levels A and B are identical to each other in polarity during a single cycle, and are each inverted between a positive polarity and a negative polarity every cycle.

The γ-LUT 14*c* includes, set therein independently of each other, (i) lookup tables for a γ conversion of the first frame and (ii) lookup tables for a γ conversion of the second frame. The lookup tables for a γ conversion of the first frame include, independent of each other, a lookup table for a positive polarity and a lookup table for a negative polarity. The lookup tables for a γ conversion of the second frame include, independent of each other, a lookup table for the positive polarity and a lookup table for the negative polarity. The γ selection circuit 14*b* switches lookup tables among the above four lookup tables to select one for use in accordance with (i) whether the gray scale data is supplied to the first frame or the second frame and (ii) whether the gray scale data has a positive polarity or a negative polarity.

Figure 4:
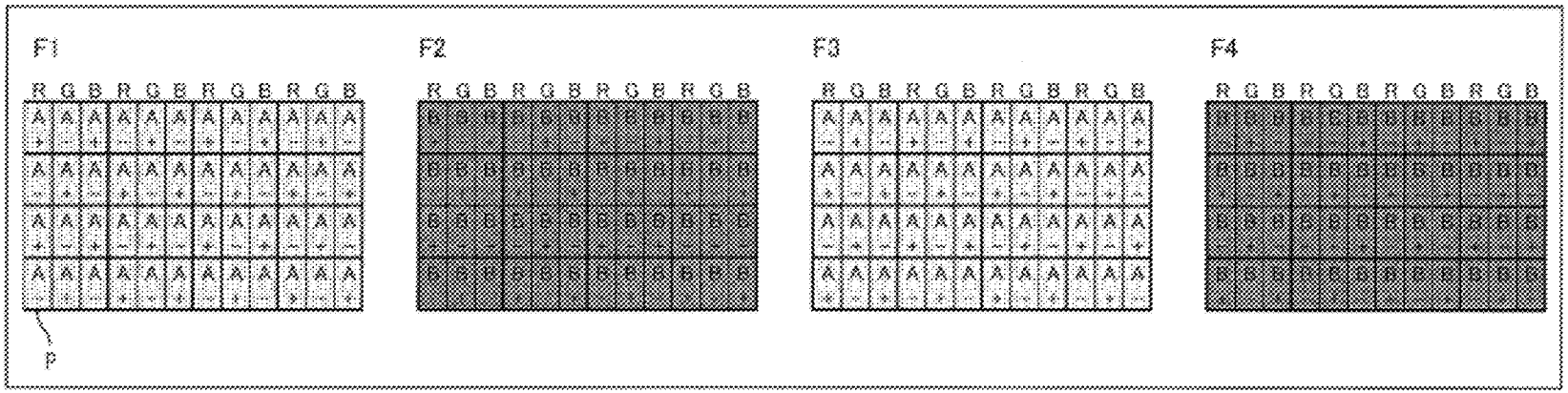
FIG. 4 is a diagram illustrating an example arrangement of pixels for the operation of FIG. 1.

The source voltages VD are supplied to pixels (that is, luminance changing pixels described below, each of which is a pixel that changes its luminance) P, which are arranged, for example, as illustrated in FIG. 4. FIG. 4 illustrates pixels P of the respective colors of R, G, and B which pixels P are arranged in that color order column by column. Each three pixels P of R, G, and B arranged next to one another in the row direction constitute a single picture element. As illustrated in FIG. 4, (i) all the pixels P are set to an identical gray level, that is, either the gray level A or B, during a single frame, and (ii) the gray levels A and B are switched every frame. This arrangement causes the pixels P to each undergo a luminance change of bright→dark→bright→dark through a frame switch of F1→F2→F3→F4. Further, the pixels in FIG. 4 are subjected to a dot inversion drive, which causes pixels adjacent to one another in both the row direction and the column direction to be inverted from one another in polarity. The pixels P may be provided throughout the entire display region or partially in the display region.

Figure 5:
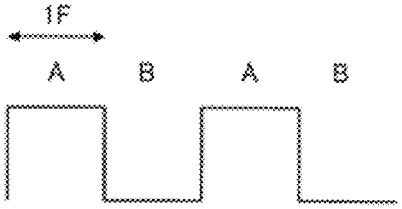
FIG. 5 is a waveform chart illustrating a luminance change pattern applicable to the operation of FIG. 1.

With the above arrangement, the pixels P each change its luminance in a pattern of, if there is no delay in response of liquid crystal molecules to a voltage application, a sequence that exhibits a repeat of bright→dark→bright→dark in the shape of a rectangular wave as illustrated in FIG. 5. There is, however, typically a delay in response in actuality, which causes the pixels to each change its luminance as indicated by the change pattern for the luminance Y in FIG. 1. The luminance Y in FIG. 1 indicates a pattern of a waveform change in which the luminance (i) gradually increases during the first frame through a transient response and (ii) gradually decreases during the second frame through a transient response. This results in an overall sequence that repeats the two-frame luminance change pattern through a cycle of two frames.

The luminance change pattern in FIG. 1 has a transition characteristic as described above. This causes the liquid crystal capacitance Clc to change in accordance with a similar transition characteristic. Specifically, with the use of liquid crystal for a normally black display, the liquid crystal capacitance Clc (i) gradually increases from Cb to Ca through a transient response to a voltage application that increases the transmittance and (ii) gradually decreases from Ca to Cb through a transient response to a voltage application that decreases the transmittance.

Thus, (i) a feed-through voltage ΔVd generated at the fall of the gate voltage during the first frame is Vb, which depends on the liquid crystal capacitance Cb existing at the end of the immediately preceding second frame, while (ii) a feed-through voltage ΔVd at the fall of the gate voltage during the second frame is Va, which depends on the liquid crystal capacitance Ca existing at the end of the immediately preceding first frame.

In view of the above, when a γ conversion process is to be carried out with reference to a lookup table included in the display control circuit 14, the present embodiment compensates for a feed-through voltage ΔVd in the γ conversion process, the compensation being determined in correspondence with a source voltage VD supplied during the immediately preceding frame. This arrangement allows data correction to a feed-through voltage ΔVd for a source voltage VD to appropriately compensate for the actually generated feed-through voltage ΔVd. FIG. 2 tabulates the details of the display drive illustrated in FIG. 1.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

Figure 3:
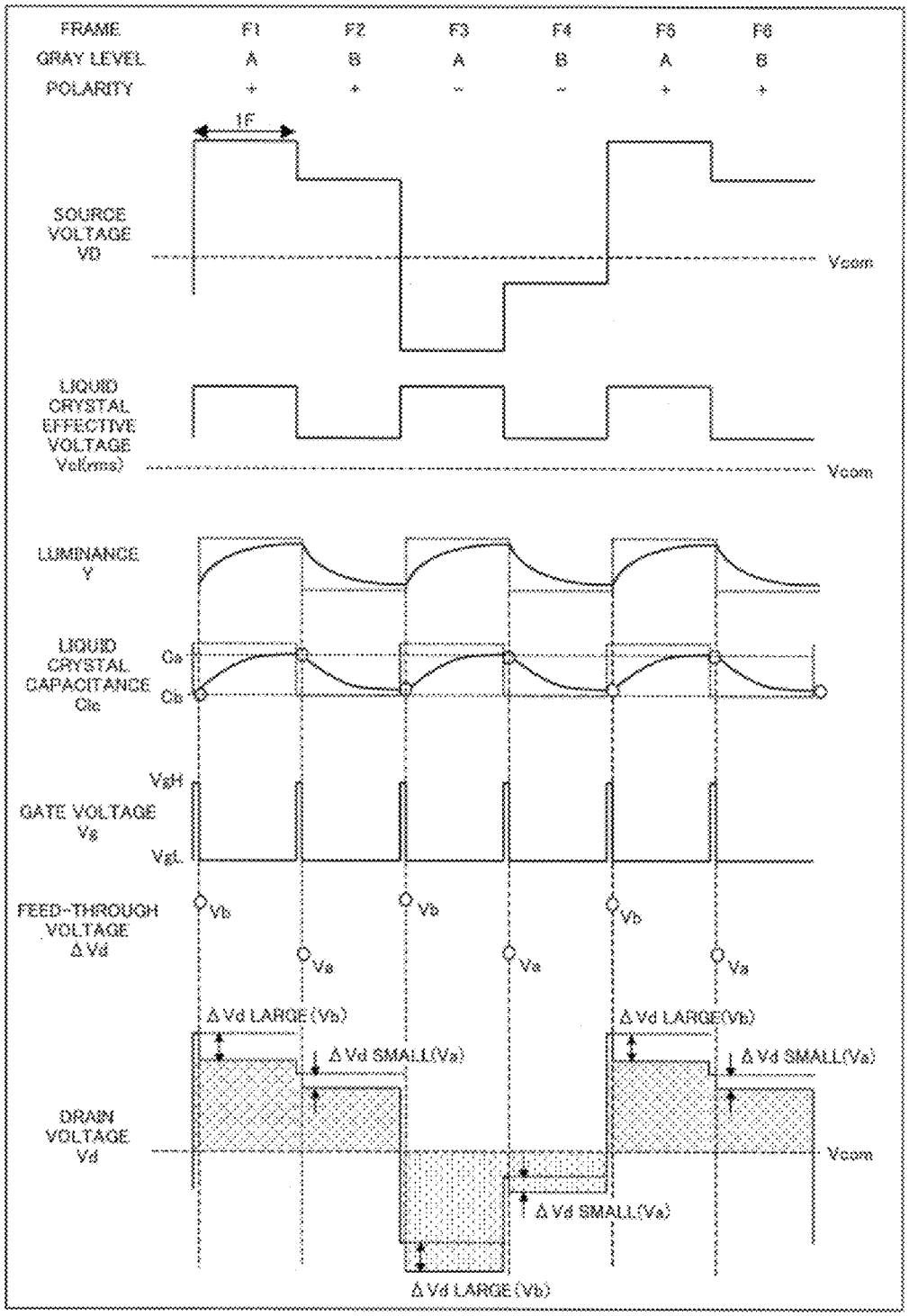
FIG. 3 is a waveform chart illustrating a Comparative Example for the operation of FIG. 1.

FIG. 3 illustrates, as a Comparative Example, individual waveforms for a case that (i) does not involve lookup tables that are independent of one another for the positive and negative polarities with respect to each of the gray levels A and B and that (ii) carries out no compensation for the feed-through voltage ΔVd. FIG. 3 indicates that the above case causes (i) a shift of a drain voltage from an optimum counter voltage and (ii) a difference in liquid crystal effective voltage between the positive and negative polarities.

The above arrangement therefore makes it possible to provide (i) a display device and (ii) a method for driving a display device each of which carries out a display with use of a temporal change in luminance of pixels and appropriately compensates for a feed-through voltage ΔVd.

Figure 6:
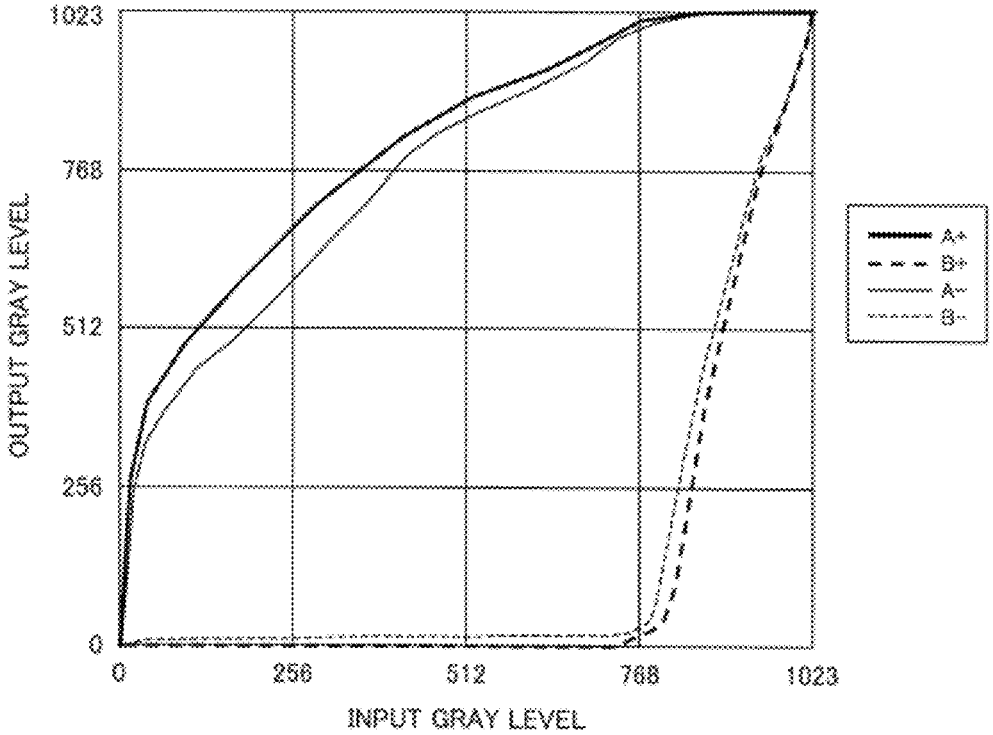
FIG. 6 is a graph illustrating gamma curves for use in the luminance change pattern of FIG. 5.

FIG. 6 illustrates an example of respective gamma curves of the gray level A+, the gray level A−, the gray level B+, and the gray level B−. FIG. 7 is an example lookup table indicative of the gamma curves. The number of gray levels is 1024 (0 to 1023).

In FIG. 6, the positive-polarity and negative-polarity gamma curves (gamma curve group; first gamma curve group) for the gray level A are each located above the corresponding one (that is, the one for an identical polarity) of the gamma curves (gamma curve group; second gamma curve group) for the gray level B for the respective polarities. Further, (i) for the gray level A, the gamma curve for use in supply of a positive-polarity source voltage VD is located above the gamma curve for use in supply of a negative-polarity source voltage VD, and (ii) for the gray level B, the gamma curve for use in supply of a positive-polarity source voltage VD is located below the gamma curve for use in supply of a negative-polarity source voltage VD. This arrangement makes it possible to, with respect to identical input gray level data, supply (i) a source voltage VA having a high gray level for the gray level A and (ii) a source voltage VB having a low gray level for the gray level B.

The description above deals with a case of a normally black display, but applies also to a normally white display except only that the liquid crystal capacitance Clc (i) gradually decreases through a transient response to a voltage application that increases the transmittance and (ii) gradually increases through a transient response to a voltage application that decreases the transmittance. Thus, a similar advantage can naturally be achieved by determining compensation for the feed-through voltage ΔVd in correspondence with a source voltage VD supplied during the immediately preceding frame.

Figure 8:
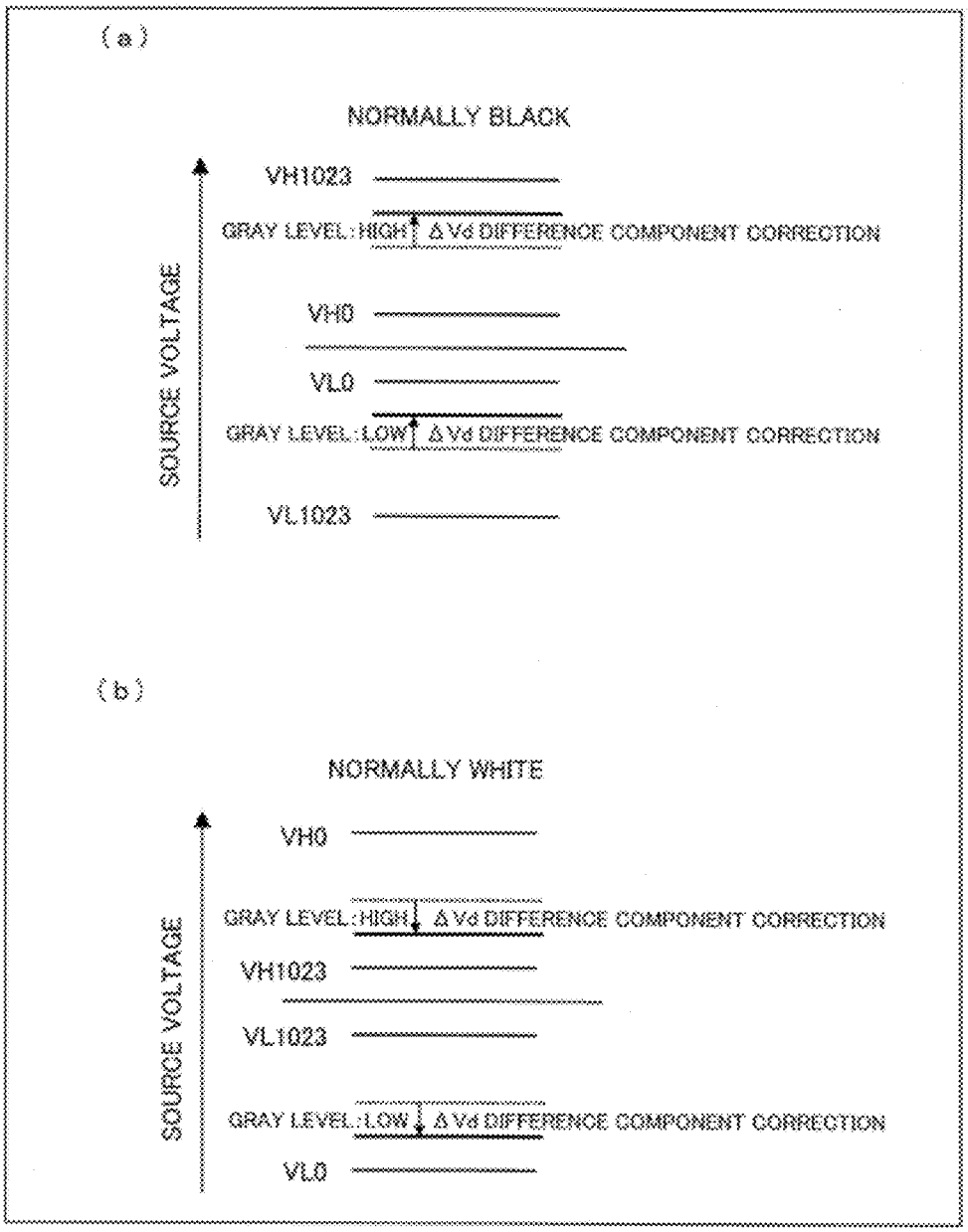
FIG. 8 is a diagram illustrating a correction of gray scale data involved in the operation of FIG. 1, where (a) illustrates a case of a normally black display, and (b) illustrates a case of a normally white display.

FIG. 8 illustrating a relation between the polarity of a source voltage VD and the amount of compensation for a feed-through voltage ΔVd. (a) of FIG. 8 illustrates the case of a normally black display, whereas (b) of FIG. 8 illustrates the case of a normally white display.

[Case of Normally Black Display]

A normally black display causes Clc to be (i) small for a dark display (low transmittance) and (ii) large for a bright display (high transmittance). A normally black display thus causes a feed-through voltage ΔVd to be (i) large for a dark display and (ii) small for a bright display. A normally black display typically involves a correction made by including, in a source voltage as a component expected to be included in the source voltage, a component attributed to the feed-through voltage.

(Case of Carrying Out Bright Display as Switched from Dark Display for Preceding Frame)

When a switch drive of dark→bright has been carried out, even if writing for a bright display is carried out by applying a source voltage for a bright display, the liquid crystal capacitance is, when the gate voltage is turned OFF, in a dark-display state (where Clc is small) achieved during the preceding frame. The actual feed-through voltage ΔVd_r is thus large. On the other hand, the source voltage for a bright display has been corrected to expect a small ΔVd_i. The correction is thus unsuited for the drive, thereby causing the actual feed-through voltage to be larger than expected.

$$\Delta Vd \text{ difference amount}=\text{expected } \Delta Vd_i(\text{small})-\text{actual feed-through voltage } \Delta Vd_r(\text{large})<0$$

The present invention carries out a correction for a ΔVd difference component with use of a source voltage, and thus corrects the source voltage in the positive direction by the ΔVd difference amount. In terms of gray levels, the above drive raises the gray level for the positive polarity and lowers the gray level for the negative polarity as illustrated in (a) of FIG. 8.

(Case of Carrying Out Dark Display as Switched from Bright Display for Preceding Frame)

When a switch drive of bright→dark has been carried out, even if writing for a dark display is carried out by applying a source voltage for a dark display, the liquid crystal capacitance is, when the gate voltage is turned OFF, in a bright-display state (where Clc is large) achieved during the preceding frame. The actual feed-through voltage ΔVd_r is thus small. On the other hand, the source voltage for a dark display has been corrected to expect a large ΔVd_i. The correction is thus unsuited for the drive, thereby causing the actual feed-through voltage to be smaller than expected.

$$\Delta Vd \text{ difference amount}=\text{expected } \Delta Vd_i(\text{large})-\text{actual feed-through voltage } \Delta Vd_r(\text{small})>0$$

The present invention carries out a correction for a ΔVd difference component with use of a source voltage, and thus corrects the source voltage in a negative direction by the ΔVd difference amount. In terms of gray levels, the above drive lowers the gray level for the positive polarity and raises the gray level for the negative polarity.

[Case of Normally White Display]

A normally white display causes Clc to be (ii) large for a dark display and (ii) small for a bright display. A normally white display thus causes a feed-through voltage ΔVd to be (i) small for a dark display and (ii) large for a bright display. A normally white display typically involves a correction made by including, in a source voltage as a component expected to be included in the source voltage, a component attributed to the feed-through voltage.

(Case of Carrying Out Bright Display as Switched from Dark Display for Preceding Frame)

When a switch drive of dark→bright has been carried out, even if writing for a bright display is carried out by applying a source voltage for a bright display, the liquid crystal capacitance is, when the gate voltage is turned OFF, in a dark-display state (where Clc is large) achieved during the preceding frame. The actual feed-through voltage ΔVd_r is thus small. On the other hand, the source voltage for a bright display has been corrected to expect a large ΔVd_i. The correction is thus unsuited for the drive, thereby causing the actual feed-through voltage to be smaller than expected.

$$\Delta Vd \text{ difference amount}=\text{expected } \Delta Vd_i(\text{large})-\text{actual feed-through voltage } \Delta Vd_r(\text{small})>0$$

The present invention carries out a correction for a ΔVd difference component with use of a source voltage, and thus corrects the source voltage in a negative direction by the ΔVd difference amount. In terms of gray levels, the above drive raises the gray level for the positive polarity and lowers the gray level for the negative polarity as illustrated in (b) of FIG. 8.

(Case of Carrying Out Dark Display as Switched from Bright Display for Preceding Frame)

When a switch drive of bright→dark has been carried out, even if wiring for a dark display is carried out by applying a source voltage for a dark display, the liquid crystal capacitance is, when the gate voltage is turned OFF, in a dark-display state (where Clc is small) achieved during the preceding frame. The actual feed-through voltage ΔVd_r is thus large. On the other hand, the source voltage for a bright display has been corrected to expect a small ΔVd_i. The correction is thus unsuited for the drive, thereby causing the actual feed-through voltage to be larger than expected.

$$\Delta Vd \text{ difference amount}=\text{expected } \Delta Vd_i(\text{small})-\text{actual feed-through voltage } \Delta Vd_r(\text{large})<0$$

The present invention carries out a correction for a ΔVd difference component with use of a source voltage, and thus corrects the source voltage in a positive direction by the ΔVd difference amount. In terms of gray levels, the above drive lowers the gray level for the positive polarity and raises the gray level for the negative polarity.

The feed-through voltage ΔVd varies according to the gray level. There is thus normally a variation, according to the gray level, in the center level between the positive and negative polarities for a source voltage VD for which ΔVd has been compensated for appropriately. This indicates that there is, for each gray level, an independent center level between the positive and negative polarities for a source voltage VD for which a γ conversion has been carried out with reference to positive and negative lookup tables independent of one another for each frame.

The liquid crystal display device 11 of the present Example can be defined as follows:

A liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided, the pixel voltage of the first pixel has a positive polarity during an i-th frame (where i is a predetermined integer that satisfies $1 \leq i \leq N$), and the pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

The first pixel is, for example, a pixel P having the waveforms of FIG. 1, whereas the second pixel is, for example, a pixel P having waveforms for the case in which the waveform of the source voltage VD in FIG. 1 is inverted across the positive and negative sides. In this case, N=2.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a $\gamma$ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage $\Delta Vd$.

The liquid crystal display device may be arranged such that VB>VC in a case where the first pixel is a pixel for which the pixel voltage has a positive polarity during a predetermined frame that has an increase in the effective value of the pixel voltage from an immediately preceding frame during the predetermined period, the increase being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

The liquid crystal display device may be arranged such that VB<VC in a case where the first pixel is a pixel for which the pixel voltage has a positive polarity during a predetermined frame that has a decrease in the effective value of the pixel voltage from an immediately preceding frame during the predetermined period, the decrease being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

The liquid crystal display device of the present Example can alternatively be defined as follows:

A liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, a pixel voltage of the first pixel has a positive polarity during an i-th frame (where i is a predetermined integer that satisfies $1 \leq i \leq N$), and a pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

The above arrangement makes it possible to determine compensation for a feed-through voltage for a $\gamma$ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

The liquid crystal display device may be arranged such that VB>VC in a case where the first pixel is a pixel for which the pixel voltage has a positive polarity during a predetermined frame during which the luminance increases, the predetermined frame being immediately preceded by a frame during which the luminance decreases, the i-th frame is the predetermined frame, and the j-th frame is a frame occurring α frames (α is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage ΔVd.

The liquid crystal display device may be arranged such that VB>VC in a case where the first pixel is a pixel for which the pixel voltage has a positive polarity during a predetermined frame during which the luminance decreases, the predetermined frame being immediately preceded by a frame during which the luminance increases, the i-th frame is the predetermined frame, and the j-th frame is a frame occurring α frames (α is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage ΔVd.

EXAMPLE 2

Figure 9:
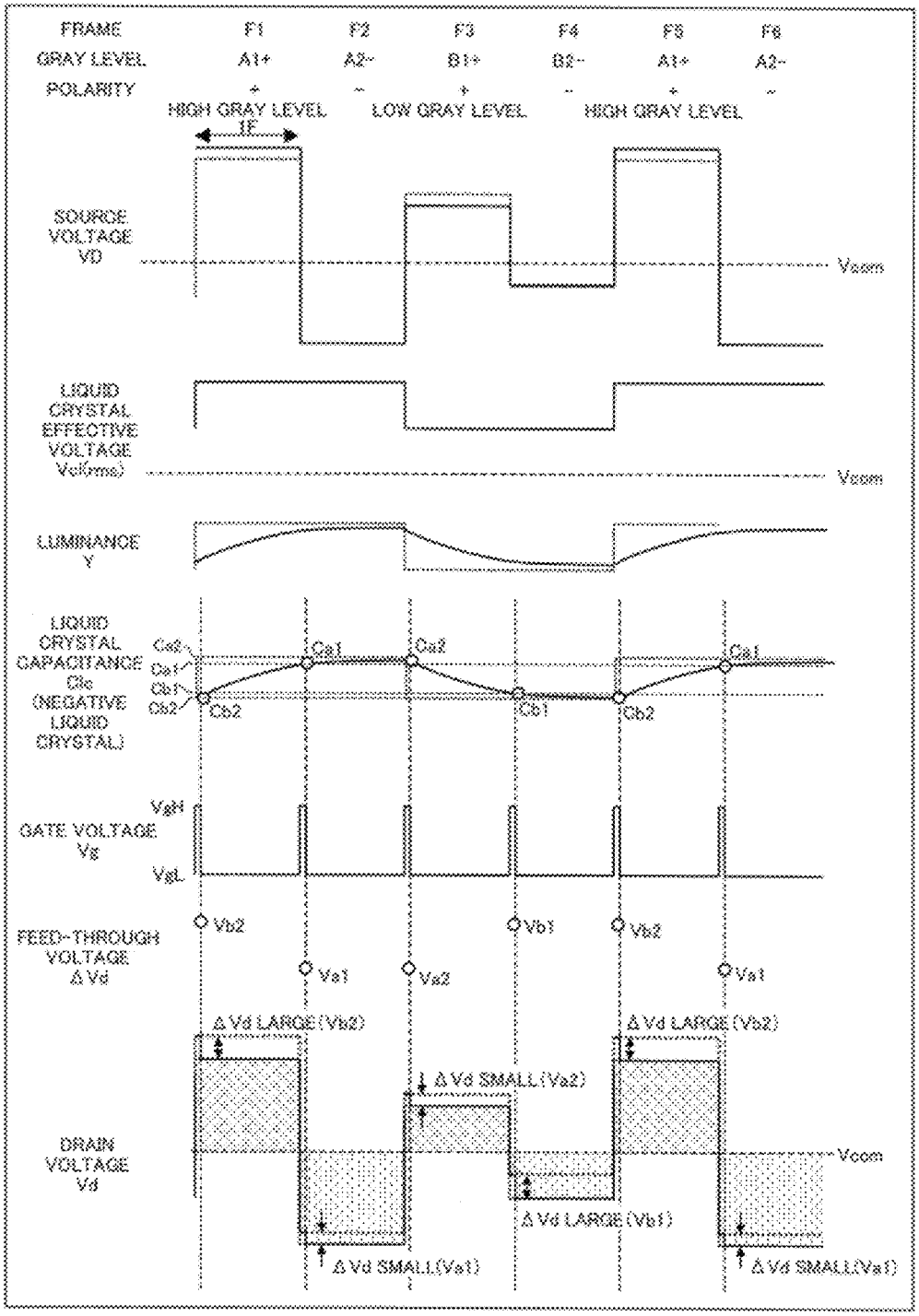
FIG. 9 is a waveform chart illustrating a second operation of a liquid crystal display device in accordance with an embodiment of the present invention.
Figure 10:
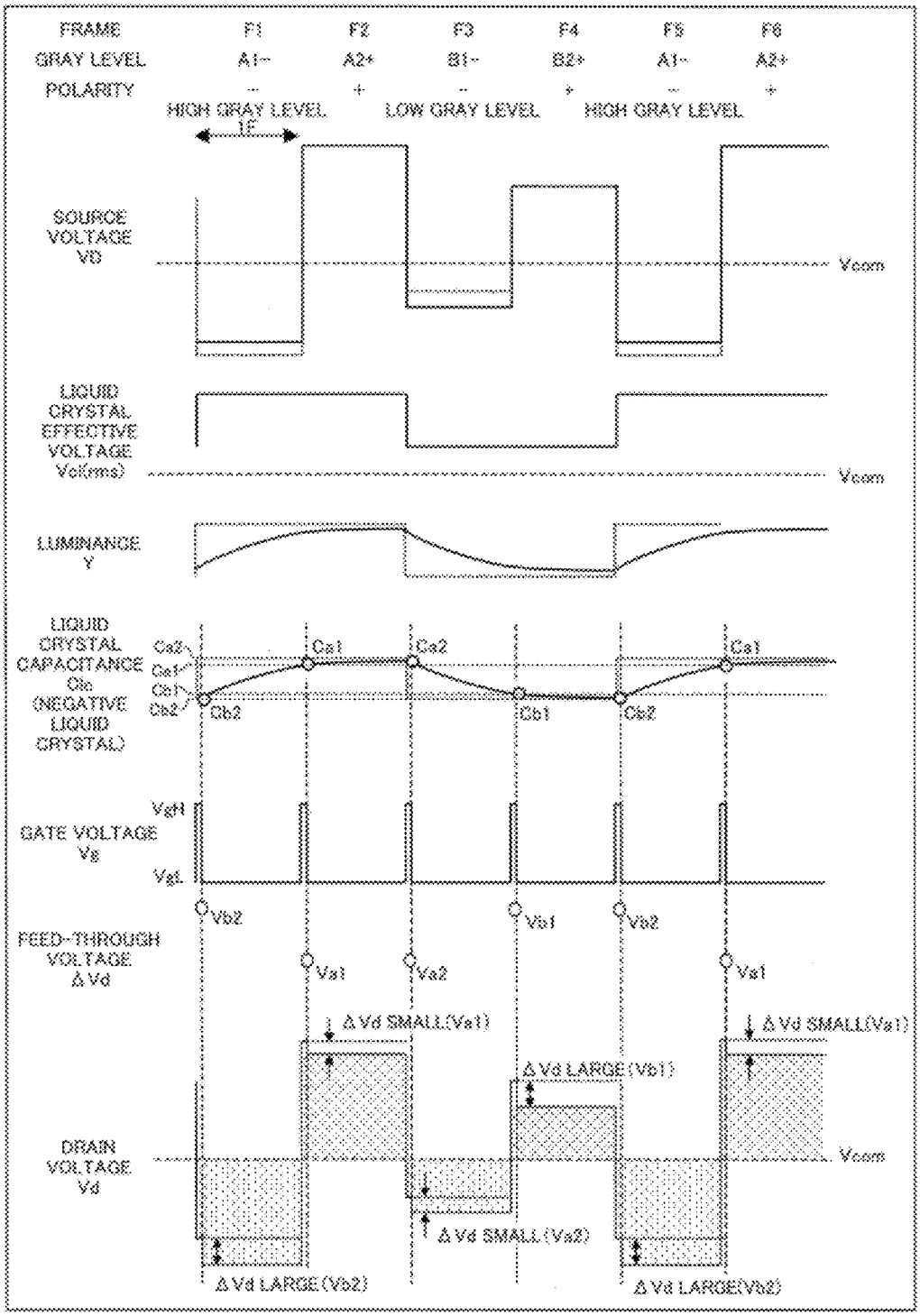
FIG. 10 is a waveform chart illustrating a third operation of a liquid crystal display device in accordance with an embodiment of the present invention.

FIGS. 9 and 10 each illustrate respective changes in (i) individual waveforms (namely, respective waveforms of a source voltage VD, a liquid crystal effective voltage Vcl(rms), a gate voltage Vg, a feed-through voltage ΔVd, and a drain voltage Vd), (ii) a luminance Y, and (iii) a liquid crystal capacitance Clc, the changes indicating another example operation of the liquid crystal display device 11.

The above waveforms are obtained for the case of, with use of the configuration of FIG. 25, carrying out a display by continuously inputting certain constant gray scale data as the input signal Yi. In the present embodiment, gray scale data that can be such constant gray scale data indicative of a waveform of FIG. 9 or 10 has a gray level indicative of a halftone for which the viewing angle characteristic is to be improved, and is determined for data Yd serving as input gray level data for a lookup table. The gray scale data that can be the above constant gray scale data may (i) be all or part of gray levels indicative of a halftone or may (ii) include a gray level (that is, black and white) indicative of no halftone of the data Yd.

In the case where constant gray scale data is continuously inputted as described above, a γ conversion with reference to the γ-LUT 14*c* in the display control circuit 14 causes source voltages VD corresponding to four respective gray levels, namely a gray level A1, a gray level A2, a gray level B1, and a gray level B2, to be supplied one after another to a single pixel frame by frame (1F) as illustrated in FIG. 9. Of four consecutive frames, (i) the first frame (in FIGS. 9 and 10, F1 or F5) involves a supply of a source voltage of the gray level A1, (ii) the second frame (in FIGS. 9 and 10, F2 or F6) involves a supply of a source voltage of the gray level A2, (iii) the third frame (in FIGS. 9 and 10, F3) involves a supply of a source voltage of the gray level B1, and (iv) the fourth frame (in FIGS. 9 and 10, F4) involves a supply of a source voltage of gray level B2, the four frames being repeated in a cycle. The gray levels A1 and A2 are higher than the gray levels B1 and B2. The description below deals with, as an example, a liquid crystal display device that carries out a normally black display. The gray levels A1 and A2 are each a level that increases luminance more than either of the gray levels B1 and B2.

The liquid crystal display device 11 is subjected to an AC drive. In FIG. 9, the gray levels A1 and B1 each have a positive polarity, whereas the gray levels A2 and B2 each have a negative polarity. In FIG. 10, the gray levels A1 and B1 each have a negative polarity, whereas the gray levels A2 and B2 each have a positive polarity. FIGS. 9 and 10 show (i) A1+, indicative of a positive-polarity gray level A1, (ii) A2+, indicative of a positive-polarity gray level A2, (iii) B1+, indicative of a positive-polarity gray level B1, and (iv) B2+, indicative of a positive-polarity gray level B2. FIGS. 9 and 10 further show (i) A1−, indicative of a negative-polarity gray level A1, (ii) A2−, indicative of a negative-polarity gray level A2, (iii) B1−, indicative of a negative-polarity gray level B1, and (iv) B2−, indicative of a negative-polarity gray level B2.

The γ-LUT 14*c* includes, set therein independently of one another, (i) lookup tables for a γ conversion of the first frame (gray level A1), (ii) lookup tables for a γ conversion of the second frame (gray level A2), (iii) lookup tables for a γ conversion of the third frame (gray level B1), and (iv) lookup tables for a γ conversion of the fourth frame (gray level B2). The lookup tables for a γ conversion of each of the first to fourth frames include, independent of each other, a lookup table for the positive polarity and a lookup table for the negative polarity. The γ selection circuit 14*b* switches lookup tables among the above eight lookup tables to select one for use in accordance with (i) which of the first to fourth frames the gray scale data is supplied to or (ii) whether the gray scale data has a positive polarity or a negative polarity.

Figure 12:
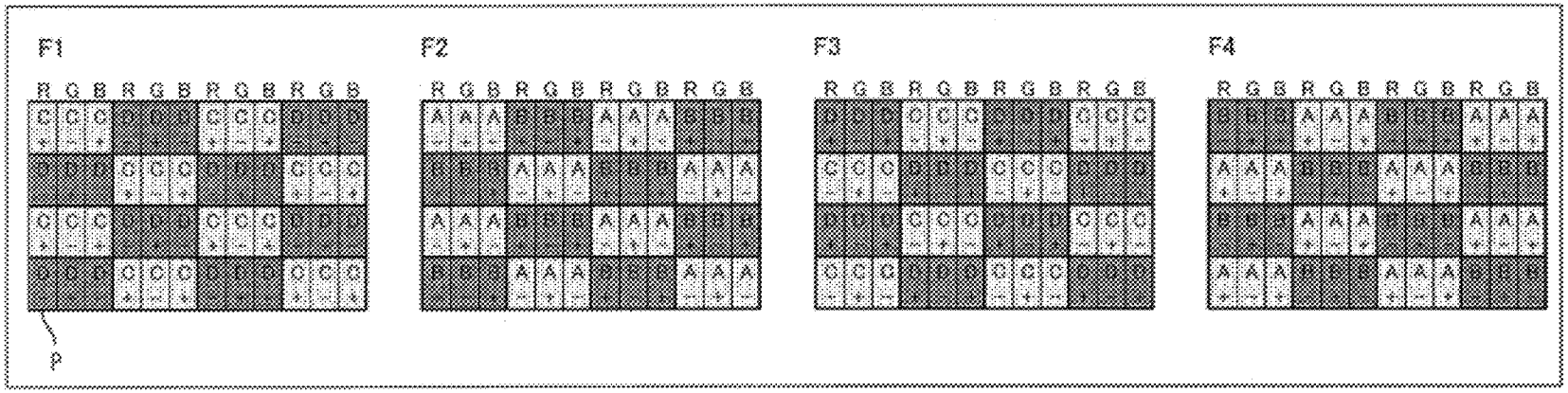
FIG. 12 is a diagram illustrating an example arrangement of pixels for the operation of each of FIGS. 9 and 10.

The data signal VD is supplied to pixels (that is, luminance changing pixels described below, each of which is a pixel that changes its luminance) P, which are arranged, for example, as illustrated in FIG. 12. FIG. 12 illustrates pixels P of the respective colors of R, G, and B which pixels P are arranged in that color order column by column. As illustrated in FIG. 12, the pixels P are arranged such that (i) a picture element including pixels P each changing its luminance in the sequence of FIG. 9 and (ii) a picture element including pixels P each changing its luminance in the sequence of FIG. 10 are arranged alternately in both the row direction and the column direction. For convenience of illustration, FIG. 12 shows C, A, D, and B to represent A1, A2, B1, and B2, respectively. Further, the pixels in FIG. 12 are subjected to a dot inversion drive, which causes pixels adjacent to one another in both the row direction and the column direction to be inverted from one another in polarity. The pixels P may be provided throughout the entire display region or partially in the display region.

Figure 13:
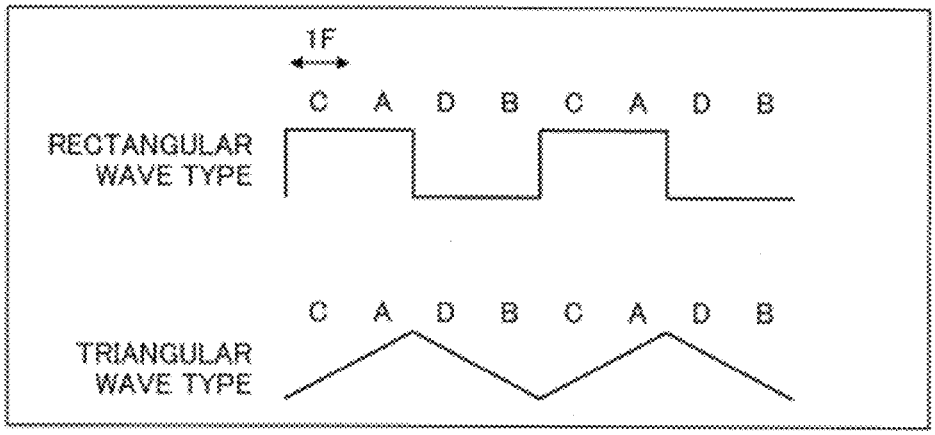
FIG. 13 is a waveform chart illustrating a luminance change pattern applicable to the operation of each of FIGS. 9 and 10.

The above arrangement can involve, as a luminance change pattern for the pixels P, a sequence as illustrated in FIG. 13, such as (i) a sequence that exhibits a repeat of bright→bright→dark→dark in the shape of a rectangular wave and (ii) a sequence that increases luminance through a period of C→A and that decreases luminance through a period of D→B in the shape of a triangular wave. FIGS. 9 and 10 each illustrate a supply of a source voltage of the gray levels of A1→A2→B1→B2, and show a waveform change in which as a result of the supply, the luminance (i) gradually increases through a transient response from the first to second frames and (ii) gradually decreases through a transient response from the third to fourth frames. This results in an overall sequence that repeats the four-frame luminance change pattern through a cycle of four frames.

The luminance change pattern in each of FIGS. 9 and 10 has a transition characteristic as described above. This causes the liquid crystal capacitance Clc to change in accordance with a similar transition characteristic. Specifically, with the use of liquid crystal for a normally black display, the liquid crystal capacitance Clc (i) gradually increases, as indicated by Ca1 and Ca2, through a transient response to a voltage application that increases the transmittance and (ii) gradually decreases, as indicated by Cb1 and Cb2, through a transient response to a voltage application that decreases the transmittance.

Thus, (i) a feed-through voltage ΔVd generated at the fall of the gate voltage during the first frame is Vb2, which depends on the liquid crystal capacitance Cb2 existing at the end of the immediately preceding fourth frame, (ii) a feed-through voltage ΔVd at the fall of the gate voltage during the second frame is Va1, which depends on the liquid crystal capacitance Ca1 existing at the end of the immediately preceding first frame, (iii) a feed-through voltage ΔVd at the fall of the gate voltage during the third frame is Va2, which depends on the liquid crystal capacitance Ca2 existing at the end of the immediately preceding second frame, and (iv) a feed-through voltage ΔVd at the fall of the gate voltage during the fourth frame is Vb1, which depends on the liquid crystal capacitance Cb1 existing at the end of the immediately preceding third frame.

In view of the above, when a γ conversion process is to be carried out with reference to a lookup table included in the display control circuit 14, the present embodiment compensates for a feed-through voltage ΔVd for the γ conversion process in an amount that is determined in correspondence with a source voltage VD supplied during the immediately preceding frame. This arrangement allows data correction to a feed-through voltage ΔVd for a source voltage VD to appropriately compensate for the actually generated feed-through voltage ΔVd. FIG. 11 tabulates the details of the display drive illustrated in each of FIGS. 9 and 10.

The above arrangement thus prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

Figure 14:
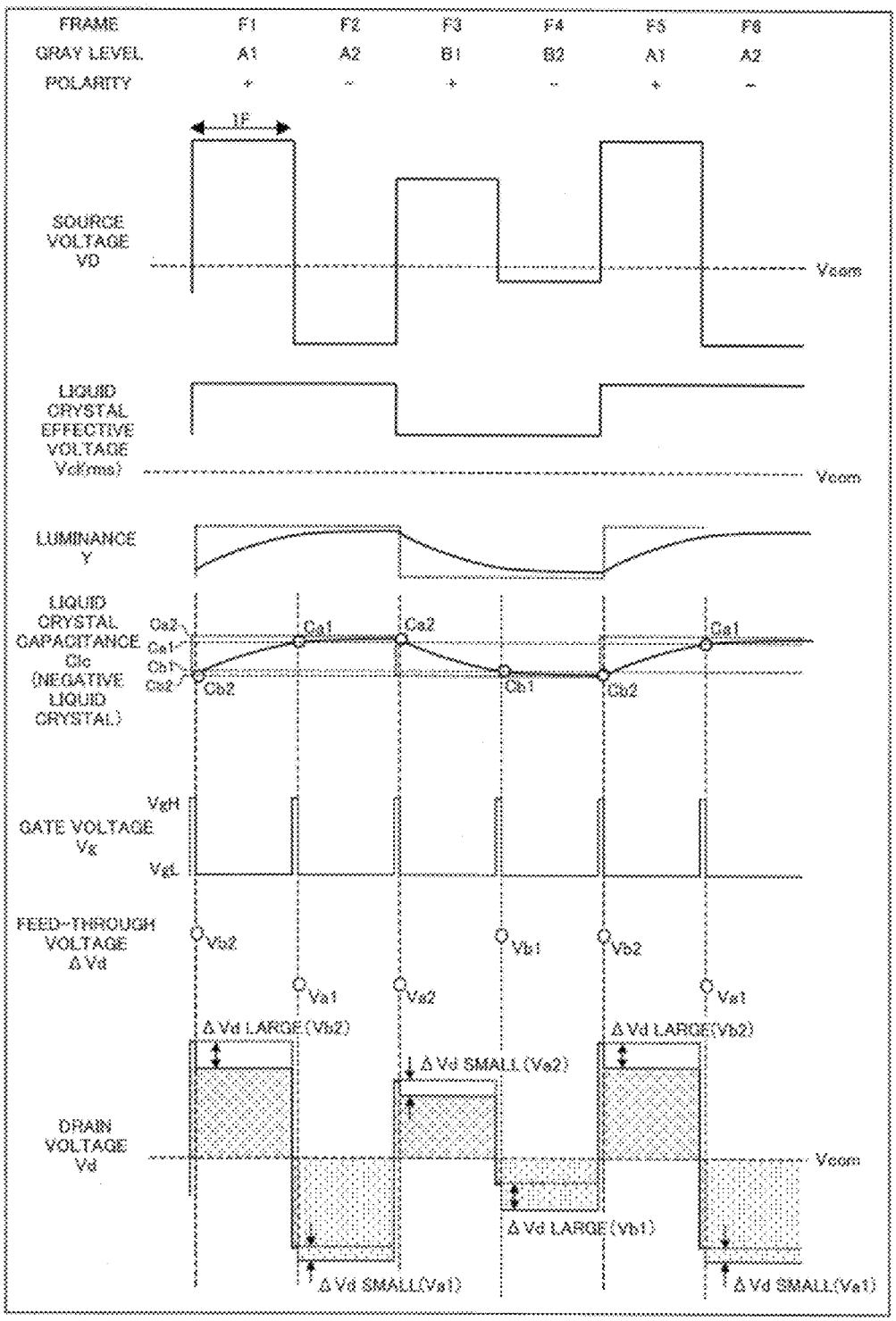
FIG. 14 is a waveform chart illustrating a Comparative Example for the operation of FIG. 9.
Figure 15:
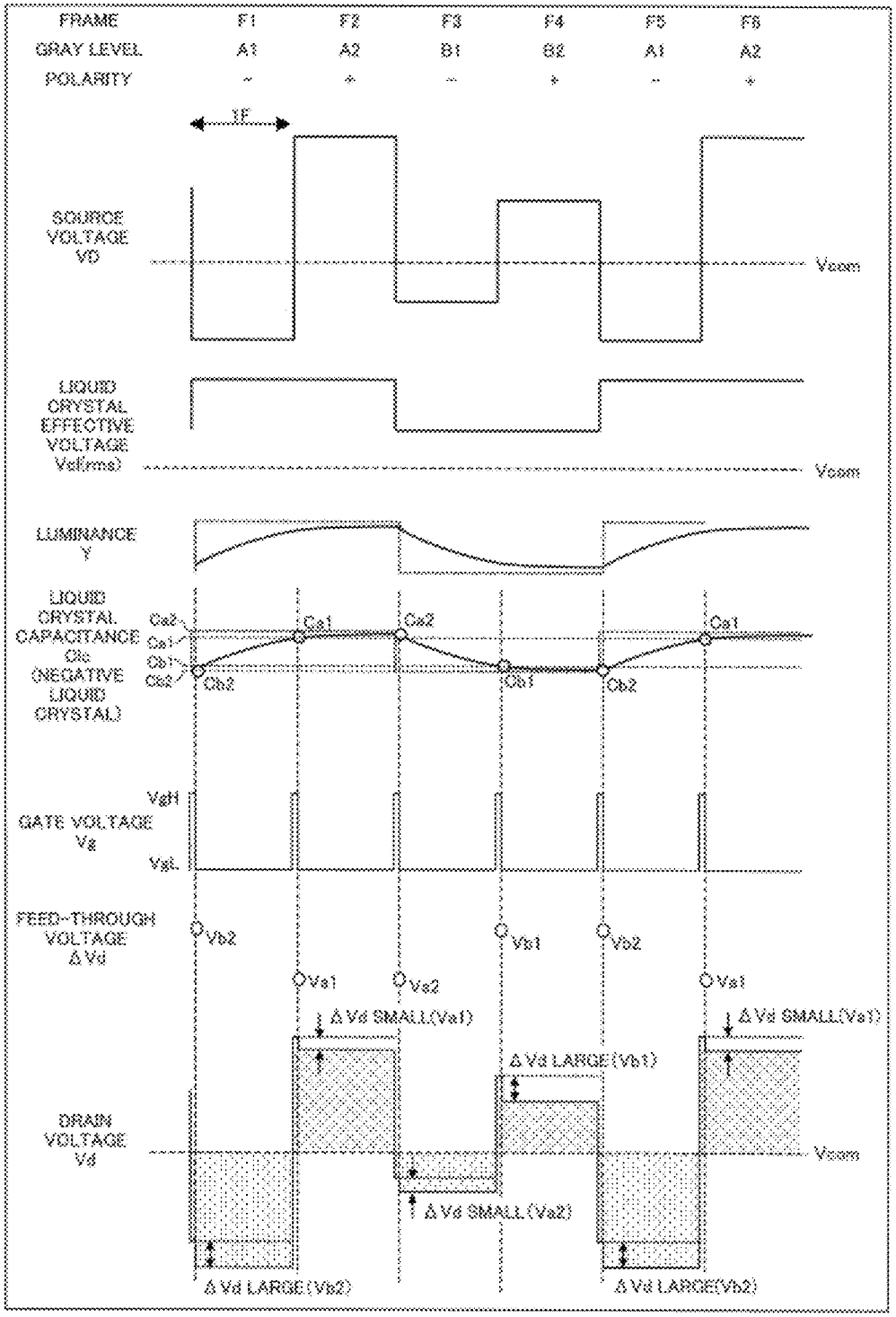
FIG. 15 is a waveform chart illustrating a Comparative Example for the operation of FIG. 10.

FIGS. 14 and 15 each illustrate, as a Comparative Example, individual waveforms for a case that (i) involves no lookup tables independent of one another for the positive and negative polarities with respect to each of the gray levels A1, A2, B1, and B2 and that (ii) carries out no compensation for the feed-through voltage ΔVd. FIGS. 14 and 15 each indicate that the above case causes (i) a shift of a drain voltage from an optimum counter voltage and (ii) a difference in liquid crystal effective voltage between the positive and negative polarities.

The above arrangement therefore makes it possible to provide (i) a display device and (ii) a method for driving a display device each of which carries out a display with use of a temporal change in luminance of pixels and appropriately compensates for a feed-through voltage ΔVd.

Figure 16:
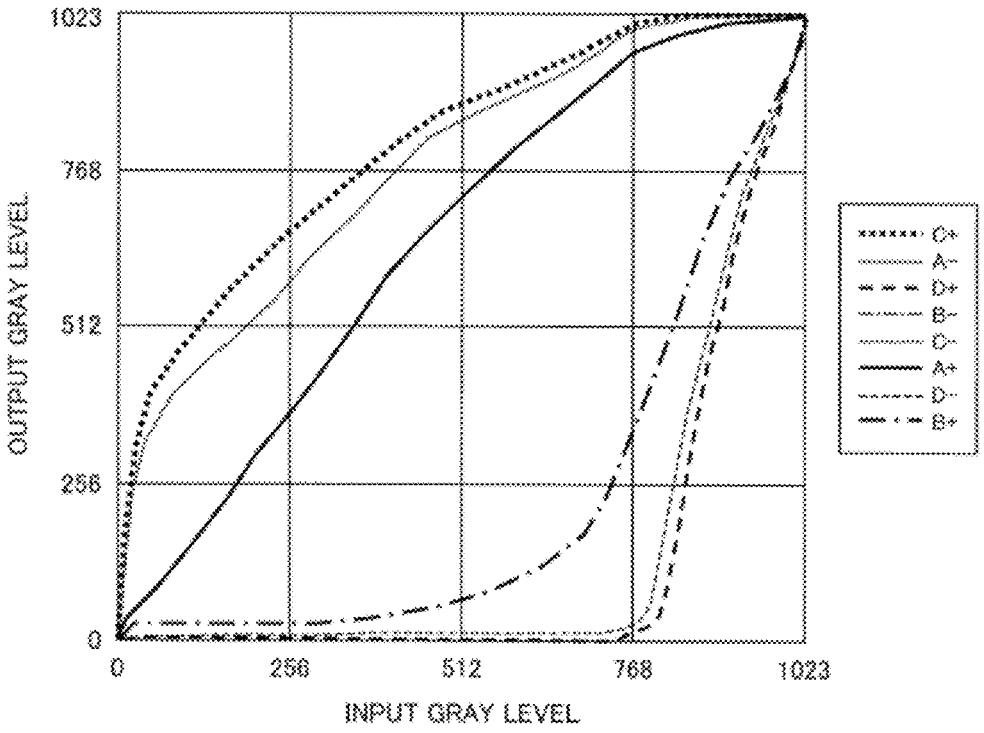
FIG. 16 is a graph illustrating gamma curves for use in a first luminance change pattern of FIG. 13.

FIG. 16 illustrates an example of respective gamma curves, for each of the positive and negative polarities, of the gray level C, the gray level A, the gray level D, and the gray level B (where C, A, D, and B are as defined for FIG. 9) each for use in generating a luminance change pattern in the shape of a rectangular wave. FIG. 17 is an example lookup table indicative of the gamma curves. The number of gray levels is 1024 (0 to 1023).

Figure 18:
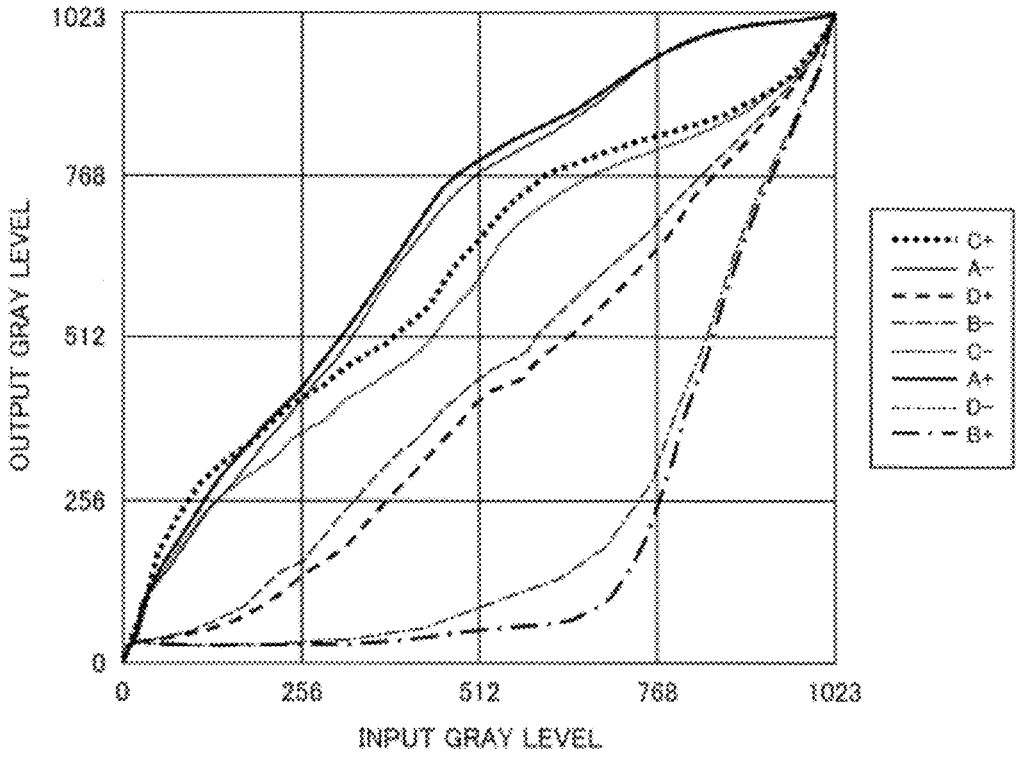
FIG. 18 is a graph illustrating gamma curves for use in a second luminance change pattern of FIG. 13.

FIG. 18 illustrates an example of respective gamma curves, for each of the positive and negative polarities, of the gray level C, the gray level A, the gray level D, and the gray level B (where C, A, D, and B are as defined for FIG. 9) each for use in generating a luminance change pattern in the shape of a triangular wave. FIG. 19 is an example lookup table indicative of the gamma curves. The number of gray levels is 1024 (0 to 1023).

In each of FIGS. 16 and 18, the positive-polarity and negative-polarity gamma curves (gamma curve group; first gamma curve group) for each of the gray levels C and A are each located above the corresponding one (that is, the one for an identical polarity) of the gamma curves (gamma curve group; second gamma curve group) for each of the gray levels D and B for the respective polarities. Further, (i) for each of the gray levels C and A, the gamma curve for use in supply of a positive-polarity source voltage VD is located above the gamma curve for use in supply of a negative-polarity source voltage VD, and (ii) for the gray levels D and B, the gamma curve for use in supply of a positive-polarity source voltage VD is located below the gamma curve for use in supply of a negative-polarity source voltage VD. This arrangement makes it possible to, with respect to identical input gray level data, supply (i) a source voltage VA having a high gray level for each of the gray levels C and A, and (ii) a source voltage VA having a low gray level for each of the gray levels D and B.

The description above deals with a case of a normally black display, but applies also to a normally white display except only that the liquid crystal capacitance Clc (i) gradually decreases through a transient response to a voltage application that increases the transmittance and (ii) gradually increases through a transient response to a voltage application that decreases the transmittance. Thus, a similar advantage can naturally be achieved by determining compensation for the feed-through voltage ΔVd in correspondence with a source voltage VD supplied during the immediately preceding frame.

Figure 20:
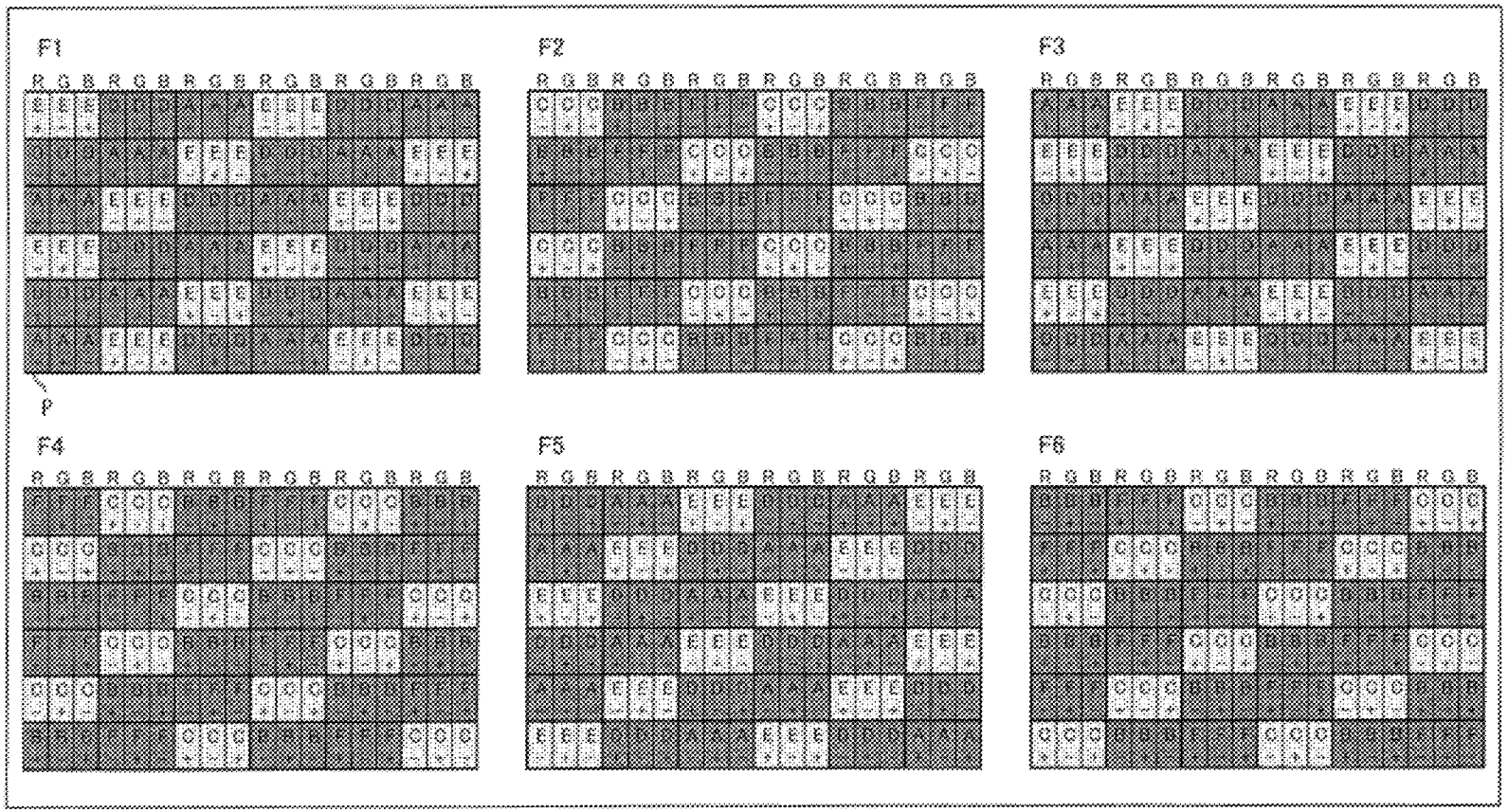
FIG. 20 is a diagram illustrating a first variation of the pixel arrangement of FIG. 12.
Figure 21:
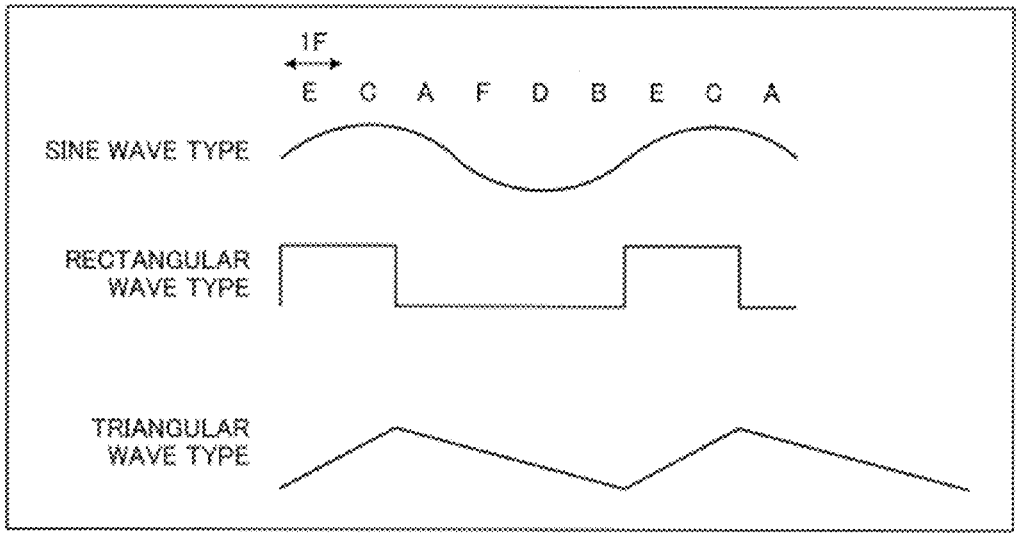
FIG. 21 is a waveform chart illustrating luminance change patterns applicable to the pixels in FIG. 20.

The display panel 12 may, as a variation of the present Example, include pixels P each changing its luminance in a six-frame cycle (E→C→A→F→D→B) as illustrated in FIG. 20. This arrangement can involve, as a luminance change pattern, a luminance change pattern in the shape of, for example, a sine wave, a rectangular wave, or a triangular wave as illustrated in FIG. 21. This arrangement can include, as the lookup tables, 12 independent lookup tables for the positive and negative polarities with respect to each of E, C, A, F, D, and B.

Figure 22:
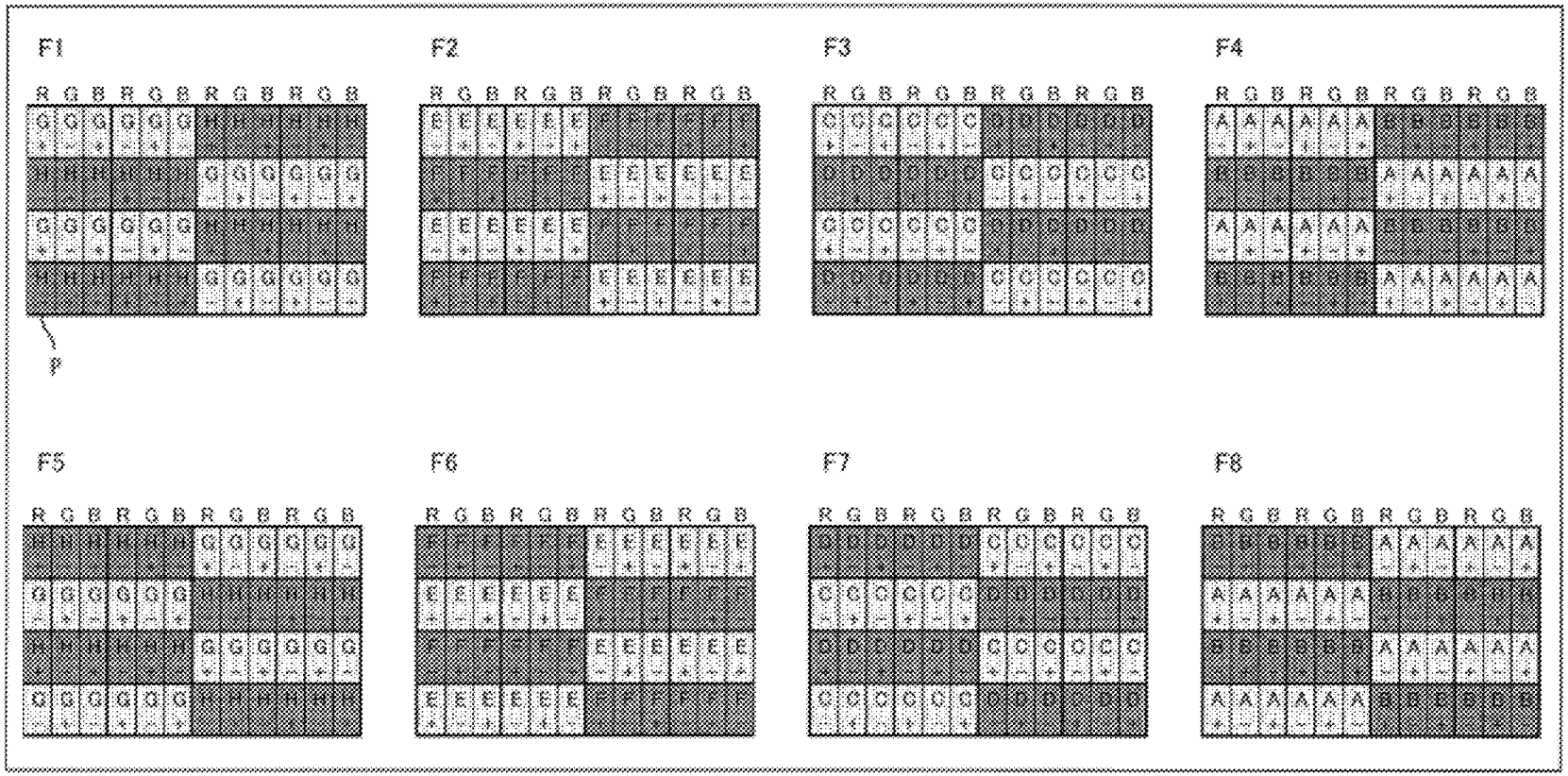
FIG. 22 is a diagram illustrating an example of a second variation of the pixel arrangement of FIG. 12.
Figure 23:
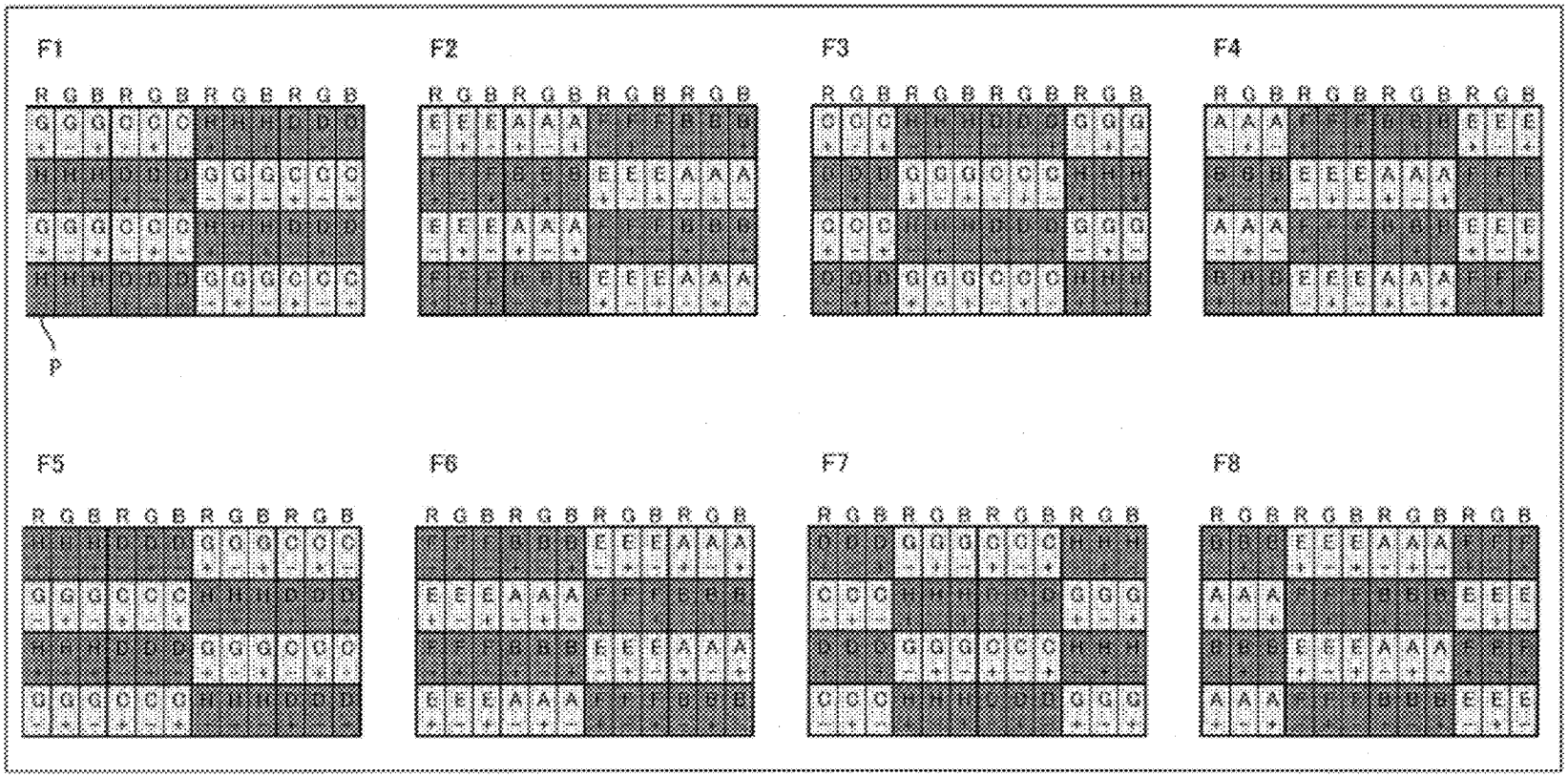
FIG. 23 is a diagram illustrating another example of the second variation of the pixel arrangement of FIG. 12.
Figure 24:
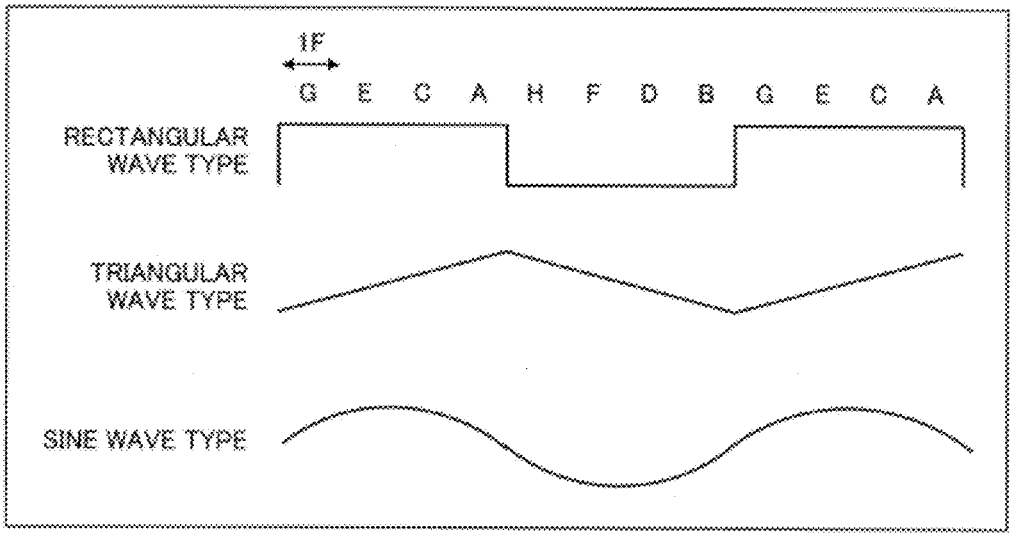
FIG. 24 is a waveform chart illustrating luminance change patterns applicable to an operation of the pixels in each of FIGS. 22 and 23.

The display panel 12 may, as a variation of the present Example, include pixels P each changing its luminance in an eight-frame cycle (G→E→C→A→H→F→D→B) as illustrated in each of FIGS. 22 and 23. This arrangement can involve, as a luminance change pattern, a luminance change pattern in the shape of, for example, a sine wave, a rectangular wave, or a triangular wave as illustrated in FIG. 24. This arrangement can include, as the lookup tables, 16 independent lookup tables for the positive and negative polarities with respect to each of G, E, C, A, H, F, D, and B.

The liquid crystal display device 11 of the present Example can be defined as follows:

A liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided that are different from each other in the effective value of the pixel voltage during an i-th frame (where i is a predetermined integer that satisfies $1 \leq i \leq N$) among the N frames, the pixel voltage of the first pixel has a positive polarity during the i-th frame, the pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

The first pixel is, for example, a pixel P having the waveforms of FIG. 9, whereas the second pixel is, for example, a pixel P having the waveforms of FIG. 10. In this case, N=4.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a $\gamma$ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage $\Delta Vd$.

The liquid crystal display device may be arranged such that VB>VC in a case where the first pixel is a pixel for which the pixel voltage has a positive polarity during a predetermined frame that has an increase in the effective value of the pixel voltage from an immediately preceding frame during the predetermined period, the increase being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

The liquid crystal display device may be arranged such that VB<VC in a case where the first pixel is a pixel for which the pixel voltage has a positive polarity during a predetermined frame that has a decrease in the effective value of the pixel voltage from an immediately preceding frame during the predetermined period, the decrease being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

The liquid crystal display device of the present Example can alternatively be defined as follows:

A liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, each as the pixel, that are different from each other in the luminance during an i-th frame (where i is a predetermined integer that satisfies $1 \leq i \leq N$) among the N frames, a pixel voltage of the first pixel has a positive polarity during the i-th frame, a pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

The above arrangement makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

The liquid crystal display device may be arranged such that VB>VC in a case where the first pixel is a pixel for which the pixel voltage has a positive polarity during a predetermined frame during which the luminance increases, the predetermined frame being immediately preceded by a frame during which the luminance decreases, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

The liquid crystal display device may be arranged such that VB<VC in a case where the first pixel is a pixel for which the pixel voltage has a positive polarity during a predetermined frame during which the luminance decreases, the predetermined frame being immediately preceded by a frame during which the luminance increases, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

The description above deals with the Examples.

Since temperature affects the value of a physical property such as liquid crystal response and a dielectric constant, the feed-through voltage ΔVd may be changed. The present invention may thus include ΔVd correction parameters set in correspondence with temperatures to compensate for the above change. In other words, VA, VB, and VC may be set independently of one another in accordance with the surface temperature of the display panel 12. This arrangement, even if the ambient temperature has changed, prevents (i) a flicker caused by a ΔVd change and (ii) a screen burn-in caused by a DC component application.

The feed-through voltage ΔVd varies over the panel surface of the display panel 12 due to a load caused by the resistance and capacitance in the wiring. The present invention may thus vary the amount of correction to ΔVd over the panel surface in correspondence with a difference in the load as indicated by the points Q1 through Q15 illustrated in FIG. 26. Further, the feed-through voltage also varies in the case where, for example, the display panel has a temperature distribution over its surface in correspondence with the position of a backlight lamp (for example, an edge lamp). The present invention may thus vary the amount of correction to ΔVd over the panel surface in correspondence with the difference in the load. In other words, VA, VB, and VC may be set independently of one another in accordance with the position on the display panel 12. This arrangement makes it possible to, over the entire panel surface, prevent (i) a flicker caused by a ΔVd change and (ii) a screen burn-in caused by a DC component application, thereby improving reliability.

As described above, in order to solve the above problems, a liquid crystal display device of the present invention is a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided that are different from each other in the effective value of the pixel voltage during an i-th frame (where i is a predetermined integer that satisfies $1 \leq i \leq N$) among the N frames, the pixel voltage of the first pixel has a positive polarity during the i-th frame, the pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

In order to solve the above problems, the liquid crystal display device of the present invention may be arranged such that VB>VC in a case where the first pixel is a pixel for which the pixel voltage has a positive polarity during a predetermined frame that has an increase in the effective value of the pixel voltage from an immediately preceding frame during the predetermined period, the increase being in an amount that is largest among the N frames, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

In order to solve the above problems, the liquid crystal display device of the present invention may be arranged such that VB<VC in a case where the first pixel is a pixel for which the pixel voltage has a positive polarity during a predetermined frame that has a decrease in the effective value of the pixel voltage from an immediately preceding frame during the predetermined period, the decrease being in an amount that is largest among the N frames, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

In order to solve the above problems, a liquid crystal display device of the present invention is a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, each as the pixel, that are different from each other in the luminance during an i-th frame (where i is a predetermined integer that satisfies $1 \leq i \leq N$) among the N frames, a pixel voltage of the first pixel has a positive polarity during the i-th frame, a pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

In order to solve the above problems, the liquid crystal display device of the present invention may be arranged such that VB>VC in a case where the first pixel is a pixel for which the pixel voltage has a positive polarity during a predetermined frame during which the luminance increases, the predetermined frame being immediately preceded by a frame during which the luminance decreases, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

In order to solve the above problems, the liquid crystal display device of the present invention may be arranged such that VB<VC in a case where the first pixel is a pixel for which the pixel voltage has a positive polarity during a predetermined frame during which the luminance decreases, the predetermined frame being immediately preceded by a frame during which the luminance increases, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

In order to solve the above problems, a liquid crystal display device of the present invention is a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided, the pixel voltage of the first pixel has a positive polarity during an i-th frame (where i is a predetermined integer that satisfies $1 \leq i \leq N$), and the pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage ΔVd.

In order to solve the above problems, the liquid crystal display device of the present invention may be arranged such that VB>VC in a case where the first pixel is a pixel for which the pixel voltage has a positive polarity during a predetermined frame that has an increase in the effective value of the pixel voltage from an immediately preceding frame during the predetermined period, the increase being in an amount that is largest among the N frames, the i-th frame is the predetermined frame, and the j-th frame is a frame occurring α frames (α is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage ΔVd.

In order to solve the above problems, the liquid crystal display device of the present invention may be arranged such that VB<VC in a case where the first pixel is a pixel for which the pixel voltage has a positive polarity during a predetermined frame that has a decrease in the effective value of the pixel voltage from an immediately preceding frame during the predetermined period, the decrease being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, a liquid crystal display device of the present invention is a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, a pixel voltage of the first pixel has a positive polarity during an i-th frame (where i is a predetermined integer that satisfies $1 \leq i \leq N$), and a pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a $\gamma$ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a liquid crystal display device that carries out a display with use of a temporal change in luminance of pixels and that appropriately compensates for a feed-through voltage $\Delta Vd$.

In order to solve the above problems, the liquid crystal display device of the present invention may be arranged such that VB>VC in a case where the first pixel is a pixel for which the pixel voltage has a positive polarity during a predetermined frame during which the luminance increases, the predetermined frame being immediately preceded by a frame during which the luminance decreases, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, the liquid crystal display device of the present invention may be arranged such that VB>VC in a case where the first pixel is a pixel for which the pixel voltage has a positive polarity during a predetermined frame during which the luminance decreases, the predetermined frame being immediately preceded by a frame during which the luminance increases, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, the liquid crystal display device of the present invention may be arranged such that VA, VB, and VC are set independently of one another in accordance with a surface temperature of a liquid crystal display panel.

The above arrangement makes it possible to, even with an ambient temperature change, advantageously prevent (i) a flicker caused by a $\Delta Vd$ change and (ii) a screen burn-in, caused by a DC component application, of a display element.

In order to solve the above problems, the liquid crystal display device of the present invention may be arranged such that VA, VB, and VC are set independently of one another in accordance with a position on a liquid crystal display panel.

The above arrangement makes it possible to advantageously prevent, over the entire panel surface, (i) a flicker caused by a $\Delta Vd$ change and (ii) a screen burn-in, caused by a DC component application, of a display element, thereby improving reliability.

In order to solve the above problems, a method of the present invention for driving a liquid crystal display device is a method for driving a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided that are different from each other in the effective value of the pixel voltage during an i-th frame (where i is a predetermined integer that satisfies $1 \leq i \leq N$) among the N frames, the pixel voltage of the first pixel has a positive polarity during the i-th frame, the pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a $\gamma$ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage $\Delta Vd$.

In order to solve the above problems, the method of the present invention for driving a liquid crystal display device may be arranged such that VB>VC in a case where the first pixel is a pixel for which the pixel voltage has a positive polarity during a predetermined frame that has an increase in the effective value of the pixel voltage from an immediately preceding frame during the predetermined period, the increase being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, the method of the present invention for driving a liquid crystal display device may be arranged such that VB<VC in a case where the first pixel is a pixel for which the pixel voltage has a positive polarity during a predetermined frame that has a decrease in the effective value of the pixel voltage from an immediately preceding frame during the predetermined period, the decrease being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, a method of the present invention for driving a liquid crystal display device is a method for driving a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, each as the pixel, that are different from each other in the luminance during an i-th frame (where i is a predetermined integer that satisfies $1 \leq i \leq N$) among the N frames, a pixel voltage of the first pixel has a positive polarity during the i-th frame, a pixel voltage of the second pixel has a negative polarity during an i{N/2 after}th frame, which is a frame occurring N/2 frames after each i-th frame during the predetermined period, and the pixel voltage of the first pixel has a polarity during a j-th frame (where j is a predetermined integer that satisfies both $1 \leq j \leq N$ and $i \neq j$) among the N frames, the polarity being different from a polarity of the pixel voltage of the second pixel during a j{N/2 after}th frame, which is a frame occurring N/2 frames after each j-th frame during the predetermined period; and either in a case where data of a first gray level as the certain gray level is to be displayed for the predetermined period, with VA being a source voltage to be supplied to the first pixel during the i-th frame, with VB being a source voltage to be supplied to the second pixel during the i{N/2 after}th frame, and in a case where (i) the pixel voltage of the first pixel during the j-th frame has a positive polarity and (ii) data of, as the certain gray level, a second gray level, which is different from the first gray level, is to be displayed for the predetermined period, with VC being a source voltage of the second pixel during the j{N/2 after}th frame, the source voltage being for a case in which a source voltage of the first pixel during the j-th frame is VA, or in a case where data of the first gray level as the certain gray level is to be displayed for the predetermined period, with VA being the source voltage to be supplied to the first pixel during the i-th frame, with VB being the source voltage to be supplied to the second pixel during the i{N/2 after}th frame, and in a case where (i) the pixel voltage of the second pixel during the j{N/2 after}th frame has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j{N/2 after}th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a γ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage ΔVd.

In order to solve the above problems, the method of the present invention for driving a liquid crystal display device may be arranged such that VB>VC in a case where the first pixel is a pixel for which the pixel voltage has a positive polarity during a predetermined frame during which the luminance increases, the predetermined frame being immediately preceded by a frame during which the luminance decreases, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

In order to solve the above problems, the method of the present invention for driving a liquid crystal display device may be arranged such that VB<VC in a case where the first pixel is a pixel for which the pixel voltage has a positive polarity during a predetermined frame during which the luminance decreases, the predetermined frame being immediately preceded by a frame during which the luminance increases, the i-th frame is the predetermined frame, and the j-th frame is a frame occurring α frames (α is a predetermined integer that satisfies $1 \leq \alpha \leq N/2-1$) before the i{N/2 after}th frame during the predetermined period.

The above arrangement makes it possible to advantageously easily provide a liquid crystal display device that carries out a display with use of a temporal change in luminance of pixels and that optimally compensates for a feed-through voltage ΔVd.

In order to solve the above problems, a method of the present invention for driving a liquid crystal display device is a method for driving a liquid crystal display device, wherein: when data of a certain gray level is to be displayed for a predetermined period, an effective value of a pixel voltage changes, the effective value of the pixel voltage changes in a cycle of N frames (where N is an even number of 2 or greater), a first pixel and a second pixel are provided, the pixel voltage of the first pixel has a positive polarity during an i-th frame (where i is a predetermined integer that satisfies $1 \leq i \leq N$), and the pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage ΔVd.

In order to solve the above problems, the method of the present invention for driving a liquid crystal display device may be arranged such that VB>VC in a case where the first pixel is a pixel for which the pixel voltage has a positive polarity during a predetermined frame that has an increase in the effective value of the pixel voltage from an immediately preceding frame during the predetermined period, the increase being in an amount that is largest among the N frames, the i-th frame is the predetermined frame, and the j-th frame is a frame occurring α frames (α is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, the method of the present invention for driving a liquid crystal display device may be arranged such that VB<VC in a case where the first pixel is a pixel for which the pixel voltage has a positive polarity during a predetermined frame that has a decrease in the effective value of the pixel voltage from an immediately preceding frame during the predetermined period, the decrease being in an amount that is largest among the N frames, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, a method of the present invention for driving a liquid crystal display device is a method for driving a liquid crystal display device, wherein: when data of a certain gray level is to be displayed for a predetermined period, a luminance of a pixel changes, the luminance of the pixel changes in a cycle of N frames (where N is an even number of 2 or greater), a first pixel and a second pixel are provided, a pixel voltage of the first pixel has a positive polarity during an i-th frame (where i is a predetermined integer that satisfies $1 \leq i \leq N$), and a pixel voltage of the second pixel has a negative polarity during the i-th frame; and in a case where data of a first gray level as the certain gray level is to be displayed for the predetermined period, with VA being a source voltage to be supplied to the first pixel during the i-th frame, with VB being a source voltage to be supplied to the second pixel during the i-th frame, and either (I) in a case where (i) the pixel voltage of the first pixel during a j-th frame (where j is a predetermined integer that satisfies both $1 \leq j \leq N$ and $i \neq j$) has a positive polarity and (ii) data of, as the certain gray level, a second gray level, which is different from the first gray level, is to be displayed for the predetermined period, with VC being a source voltage of the second pixel during the j-th frame, the source voltage being for a case in which a source voltage of the first pixel during the j-th frame is VA, or (II) in a case where (i) the pixel voltage of the second pixel during the j-th frame (where j is a predetermined integer that satisfies both $1 \leq j \leq N$ and $i \neq j$) has a positive polarity and (ii) data of, as the certain gray level, the second gray level, which is different from the first gray level, is to be displayed for the predetermined period, with VC being a source voltage of the first pixel during the j-th frame, the source voltage being for a case in which a source voltage of the second pixel during the j-th frame is VA, VB and VC are different from each other.

According to the above arrangement, (i) the gamma curves of the i-th frame and those of the j-th frame are independent of each other, and (ii) the respective gamma curves of the i-th frame for the positive and negative polarities are independent of each other, whereas the respective gamma curves of the j-th frame for the positive and negative polarities are independent of each other. The above arrangement thus makes it possible to determine compensation for a feed-through voltage for a $\gamma$ conversion process in correspondence with a source voltage supplied during the immediately preceding frame. The above arrangement thereby allows data correction to a feed-through voltage for a source voltage to appropriately compensate for the actually generated feed-through voltage.

The above arrangement consequently prevents a flicker caused by a shift of the voltage applied to liquid crystal from an optimum counter voltage. The above arrangement further (i) causes the liquid crystal effective voltage to be equal between the opposite polarities, and (ii) makes it possible to cancel a DC component, included in the voltage applied to liquid crystal, with an AC drive, thereby preventing a decrease in reliability.

The above arrangement, as a result, makes it possible to advantageously provide a method for driving a liquid crystal display device which method carries out a display with use of a temporal change in luminance of pixels and appropriately compensates for a feed-through voltage $\Delta Vd$.

In order to solve the above problems, the method of the present invention for driving a liquid crystal display device may be arranged such that VB>VC in a case where the first pixel is a pixel for which the pixel voltage has a positive polarity during a predetermined frame during which the luminance increases, the predetermined frame being immediately preceded by a frame during which the luminance decreases, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, the method of the present invention for driving a liquid crystal display device may be arranged such that VB>VC in a case where the first pixel is a pixel for which the pixel voltage has a positive polarity during a predetermined frame during which the luminance decreases, the predetermined frame being immediately preceded by a frame during which the luminance increases, the i-th frame is the predetermined frame, and the j-th frame is a frame occurring $\alpha$ frames ($\alpha$ is a predetermined integer that satisfies $1 \leq \alpha \leq N/2-1$) before a frame occurring N/2 frames after each i-th frame during the predetermined period.

The above arrangement makes it possible to advantageously easily provide a liquid crystal display device that carries out a display with use of a temporal change in luminance of pixels and that optimally compensates for a feed-through voltage $\Delta Vd$.

In order to solve the above problems, the method of the present invention for driving a liquid crystal display device may be arranged such that VA, VB, and VC are set independently of one another in accordance with a surface temperature of a liquid crystal display panel.

The above arrangement makes it possible to, even with an ambient temperature change, advantageously prevent (i) a flicker caused by a $\Delta Vd$ change and (ii) a screen burn-in, caused by a DC component application, of a display element.

In order to solve the above problems, the method of the present invention for driving a liquid crystal display device may be arranged such that VA, VB, and VC are set independently of one another in accordance with a position on a liquid crystal display panel.

The above arrangement makes it possible to, over the entire panel surface, advantageously prevent (i) a flicker caused by a ΔVd change and (ii) a screen burn-in, caused by a DC component application, of a display element, thereby improving reliability.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

The present invention is suitably applicable to an active matrix display device.

The invention claimed is:

1. A liquid crystal display device,
wherein:
when data of a certain gray level is to be displayed individually by each of a first pixel and a second pixel for a predetermined period,
an effective value of a pixel voltage of each of the first and second pixels changes,
the effective value of the pixel voltage changes in a cycle of N frames (where N is an even number of 4 or greater),
the N frames include a first period and a second period,
the effective value of the pixel voltage of the first pixel during the first period is larger than the effective value of the pixel voltage of the first pixel during the second period,
the effective value of the pixel voltage of the second pixel during the first period is smaller than the effective value of the pixel voltage of the second pixel during the second period,
an initial frame within the first period is an I-th frame,
an initial frame within the second period is a J-th frame,
the pixel voltage of the first pixel during the I-th frame has a first polarity,
the pixel voltage of the first pixel during a K-th frame, which is a frame within the first period and which is different from the I-th frame, has a second polarity, which is different from the first polarity,
the pixel voltage of the second pixel during an L-th frame, which is a frame within the second period and which is different from the J-th frame, has the first polarity, and
the pixel voltage of the second pixel during the J-th frame has the second polarity; and
in a case where data of a first gray level as the certain gray level is to be displayed by the first and second pixels for the predetermined period,
with VA being a source voltage to be supplied to the first pixel during the I-th frame,
with VB being a source voltage to be supplied to the second pixel during the J-th frame,
in a case where data of a second gray level as the certain gray level is to be displayed by the first and second pixels for the predetermined period,
with VA' being a source voltage to be supplied to the second pixel during the L-th frame,
with VC being a source voltage to be supplied to the first pixel during the K-th frame,
in a case where VA=VA' for the first gray level and the second gray level, VB>VC.

2. The liquid crystal display device according to claim 1,
wherein:
the effective value of the pixel voltage of the first pixel during the I-th frame within the first period is larger than the effective value of the pixel voltage of the first pixel during a frame immediately preceding the I-th frame; and
the effective value of the pixel voltage of the second pixel during the J-th frame within the second period is larger than the effective value of the pixel voltage of the second pixel during a frame immediately preceding the J-th frame.

3. The liquid crystal display device according to claim 1,
wherein:
the pixel voltage of each of the first and second pixels has a polarity that is inverted every frame.

4. A normally black liquid crystal display device,
wherein:
when data of a certain gray level is to be displayed individually by each of a first pixel and a second pixel for a predetermined period,
a luminance of each of the first and second pixels changes,
the luminance of each of the first and second pixels changes in a cycle of N frames (where N is an even number of 4 or greater),
the N frames include a first period and a second period,
the luminance of the first pixel during the first period is larger than the luminance of the first pixel during the second period,
the luminance of the second pixel during the first period is smaller than the luminance of the second pixel during the second period,
an initial frame within the first period is an I-th frame,
an initial frame within the second period is a J-th frame,
a pixel voltage of the first pixel during the I-th frame has a first polarity,
the pixel voltage of the first pixel during a K-th frame, which is a frame within the first period and which is different from the I-th frame, has a second polarity, which is different from the first polarity,
a pixel voltage of the second pixel during an L-th frame, which is a frame within the second period and which is different from the J-th frame, has the first polarity, and
the pixel voltage of the second pixel during the J-th frame has the second polarity; and
in a case where data of a first gray level as the certain gray level is to be displayed by the first and second pixels for the predetermined period,
with VA being a source voltage to be supplied to the first pixel during the I-th frame,
with VB being a source voltage to be supplied to the second pixel during the J-th frame,
in a case where data of a second gray level as the certain gray level is to be displayed by the first and second pixels for the predetermined period,
with VA' being a source voltage to be supplied to the second pixel during the L-th frame,
with VC being a source voltage to be supplied to the first pixel during the K-th frame,
in a case where VA=VA' for the first gray level and the second gray level, VB>VC.

5. The liquid crystal display device according to claim 4,
wherein:
the luminance of the first pixel during the I-th frame within the first period is larger than the luminance of the first pixel during a frame immediately preceding the I-th frame; and
the luminance of the second pixel during the J-th frame within the second period is larger than the luminance of the second pixel during a frame immediately preceding the J-th frame.

6. The liquid crystal display device according to claim 4, wherein:

the first polarity is a positive polarity; and in the case where VA=VA' for the first gray level and the second gray level, the second gray level is higher than the first gray level.

7. The method according to claim 6, wherein:

the I-th frame is continuous with the J-th frame; and the method inverts a polarity of the pixel voltage of each of the first and second pixels every two frames.

8. A normally white liquid crystal display device, wherein:

when data of a certain gray level is to be displayed individually by each of a first pixel and a second pixel for a predetermined period, a luminance of each of the first and second pixels changes, the luminance of each of the first and second pixels changes in a cycle of N frames (where N is an even number of 4 or greater), the N frames include a first period and a second period, the luminance of the first pixel during the first period is smaller than the luminance of the first pixel during the second period, the luminance of the second pixel during the first period is larger than the luminance of the second pixel during the second period, an initial frame within the first period is an I-th frame, an initial frame within the second period is a J-th frame, a pixel voltage of the first pixel during the I-th frame has a first polarity, the pixel voltage of the first pixel during a K-th frame, which is a frame within the first period and which is different from the I-th frame, has a second polarity, which is different from the first polarity, a pixel voltage of the second pixel during an L-th frame, which is a frame within the second period and which is different from the J-th frame, has the first polarity, and the pixel voltage of the second pixel during the J-th frame has the second polarity; and in a case where data of a first gray level as the certain gray level is to be displayed by the first and second pixels for the predetermined period, with VA being a source voltage to be supplied to the first pixel during the I-th frame, with VB being a source voltage to be supplied to the second pixel during the J-th frame, in a case where data of a second gray level as the certain gray level is to be displayed by the first and second pixels for the predetermined period, with VA' being a source voltage to be supplied to the second pixel during the L-th frame, with VC being a source voltage to be supplied to the first pixel during the K-th frame, in a case where VA=VA' for the first gray level and the second gray level, VB>VC.

9. The liquid crystal display device according to claim 8, wherein:

the luminance of the first pixel during the I-th frame within the first period is smaller than the luminance of the first pixel during a frame immediately preceding the I-th frame; and the luminance of the second pixel during the J-th frame within the second period is smaller than the luminance of the second pixel during a frame immediately preceding the J-th frame.

10. The liquid crystal display device according to claim 8, wherein:

the first polarity is a positive polarity; and in the case where VA=VA' for the first gray level and the second gray level, the first gray level is higher than the second gray level.

11. A liquid crystal display device, wherein:

when data of a certain gray level is to be displayed individually by each of a first pixel and a second pixel for a predetermined period, an effective value of a pixel voltage of each of the first and second pixels changes periodically, the effective value of the pixel voltage of the first pixel during an I-th frame is larger than the effective value of the pixel voltage of the first pixel during a frame immediately preceding the I-th frame, the effective value of the pixel voltage of the first pixel during a J-th frame is smaller than the effective value of the pixel voltage of the first pixel during a frame immediately preceding the J-th frame, the effective value of the pixel voltage of the second pixel during the I-th frame is larger than the effective value of the pixel voltage of the second pixel during the frame immediately preceding the I-th frame, the effective value of the pixel voltage of the second pixel during the J-th frame is smaller than the effective value of the pixel voltage of the second pixel during the frame immediately preceding the J-th frame, the pixel voltage of the first pixel during the I-th frame has a first polarity, the pixel voltage of the first pixel during the J-th frame has the first polarity, the pixel voltage of the second pixel during the I-th frame has a second polarity, which is different from the first polarity, and the pixel voltage of the second pixel during the J-th frame has the second polarity; and in a case where data of a first gray level as the certain gray level is to be displayed by the first and second pixels for the predetermined period, with VA being a source voltage to be supplied to the first pixel during the I-th frame, with VB being a source voltage to be supplied to the second pixel during the I-th frame, in a case where data of a second gray level as the certain gray level is to be displayed by the first and second pixels for the predetermined period, with VA' being a source voltage to be supplied to the first pixel during the J-th frame, with VC being a source voltage to be supplied to the second pixel during the J-th frame, in a case where VA=VA' for the first gray level and the second gray level, VB>VC.

12. The liquid crystal display device according to claim 11, wherein:

the I-th frame is continuous with the J-th frame; and the pixel voltage of each of the first and second pixels has a polarity that is inverted every two frames.

13. A normally black liquid crystal display device, wherein:

when data of a certain gray level is to be displayed individually by each of a first pixel and a second pixel for a predetermined period, a luminance of each of the first and second pixels changes periodically, the luminance of the first pixel during an I-th frame is larger than the luminance of the first pixel during a frame immediately preceding the I-th frame, the luminance of the first pixel during a J-th frame is smaller than the luminance of the first pixel during a frame immediately preceding the J-th frame, the luminance of the second pixel during the I-th frame is larger than the luminance of the second pixel during the frame immediately preceding the I-th frame, the luminance of the second pixel during the J-th frame is smaller than the luminance of the second pixel during the frame immediately preceding the J-th frame, a pixel voltage of the first pixel during the I-th frame has a first polarity, the pixel voltage of the first pixel during the J-th frame has the first polarity, a pixel voltage of the second pixel during the I-th frame has a second polarity, which is different from the first polarity, and the pixel voltage of the second pixel during the J-th frame has the second polarity; and in a case where data of a first gray level as the certain gray level is to be displayed by the first and second pixels for the predetermined period, with VA being a source voltage to be supplied to the first pixel during the I-th frame, with VB being a source voltage to be supplied to the second pixel during the I-th frame, in a case where data of a second gray level as the certain gray level is to be displayed by the first and second pixels for the predetermined period, with VA' being a source voltage to be supplied to the first pixel during the J-th frame, with VC being a source voltage to be supplied to the second pixel during the J-th frame, in a case where VA=VA' for the first gray level and the second gray level, VB>VC.

14. The liquid crystal display device according to claim 13, wherein:

the first polarity is a positive polarity; and in the case where VA=VA' for the first gray level and the second gray level, the second gray level is higher than the first gray level.

15. A normally white liquid crystal display device, wherein:

when data of a certain gray level is to be displayed individually by each of a first pixel and a second pixel for a predetermined period, a luminance of each of the first and second pixels changes periodically, the luminance of the first pixel during an I-th frame is smaller than the luminance of the first pixel during a frame immediately preceding the I-th frame, the luminance of the first pixel during a J-th frame is larger than the luminance of the first pixel during a frame immediately preceding the J-th frame, the luminance of the second pixel during the I-th frame is smaller than the luminance of the second pixel during the frame immediately preceding the I-th frame, the luminance of the second pixel during the J-th frame is larger than the luminance of the second pixel during the frame immediately preceding the J-th frame, a pixel voltage of the first pixel during the I-th frame has a first polarity, the pixel voltage of the first pixel during the J-th frame has the first polarity, a pixel voltage of the second pixel during the I-th frame has a second polarity, which is different from the first polarity, and the pixel voltage of the second pixel during the J-th frame has the second polarity; and in a case where data of a first gray level as the certain gray level is to be displayed by the first and second pixels for the predetermined period, with VA being a source voltage to be supplied to the first pixel during the I-th frame, with VB being a source voltage to be supplied to the second pixel during the I-th frame, in a case where data of a second gray level as the certain gray level is to be displayed by the first and second pixels for the predetermined period, with VA' being a source voltage to be supplied to the first pixel during the J-th frame, with VC being a source voltage to be supplied to the second pixel during the J-th frame, in a case where VA=VA' for the first gray level and the second gray level, VB>VC.

16. The liquid crystal display device according to claim 15, wherein:

the first polarity is a positive polarity; and in the case where VA=VA' for the first gray level and the second gray level, the first gray level is higher than the second gray level.

17. A method for driving a liquid crystal display device, wherein:

when data of a certain gray level is to be displayed individually by each of a first pixel and a second pixel for a predetermined period, an effective value of a pixel voltage of each of the first and second pixels changes, the effective value of the pixel voltage changes in a cycle of N frames (where N is an even number of 4 or greater), the N frames include a first period and a second period, the effective value of the pixel voltage of the first pixel during the first period is larger than the effective value of the pixel voltage of the first pixel during the second period, the effective value of the pixel voltage of the second pixel during the first period is smaller than the effective value of the pixel voltage of the second pixel during the second period, an initial frame within the first period is an I-th frame, an initial frame within the second period is a J-th frame, the pixel voltage of the first pixel during the I-th frame has a first polarity, the pixel voltage of the first pixel during a K-th frame, which is a frame within the first period and which is different from the I-th frame, has a second polarity, which is different from the first polarity, the pixel voltage of the second pixel during an L-th frame, which is a frame within the second period and which is different from the J-th frame, has the first polarity, and the pixel voltage of the second pixel during the J-th frame has the second polarity, the method comprising the steps of:

in a case where data of a first gray level as the certain gray level is to be displayed by the first and second pixels for the predetermined period, supplying a source voltage having a voltage of VA to the first pixel during the I-th frame;

supplying a source voltage having a voltage of VB to the second pixel during the J-th frame;

in a case where data of a second gray level as the certain gray level is to be displayed by the first and second pixels for the predetermined period, supplying a source voltage having a voltage of VA' to the second pixel during the L-th frame; and supplying a source voltage having a voltage of VC to the first pixel during the K-th frame, wherein:

in a case where VA=VA' for the first gray level and the second gray level, VB>VC.

18. The method according to claim 17, wherein:

the effective value of the pixel voltage of the first pixel during the I-th frame within the first period is larger than the effective value of the pixel voltage of the first pixel during a frame immediately preceding the I-th frame; and the effective value of the pixel voltage of the second pixel during the J-th frame within the second period is larger than the effective value of the pixel voltage of the second pixel during a frame immediately preceding the J-th frame.

19. The method according to claim 17, wherein:

the method inverts a polarity of the pixel voltage of each of the first and second pixels every frame.

20. A method for driving a normally black liquid crystal display device, wherein:

when data of a certain gray level is to be displayed individually by each of a first pixel and a second pixel for a predetermined period, a luminance of each of the first and second pixels changes, the luminance of each of the first and second pixels changes in a cycle of N frames (where N is an even number of 4 or greater), the N frames include a first period and a second period, the luminance of the first pixel during the first period is larger than the luminance of the first pixel during the second period, the luminance of the second pixel during the first period is smaller than the luminance of the second pixel during the second period, an initial frame within the first period is an I-th frame, an initial frame within the second period is a J-th frame, a pixel voltage of the first pixel during the I-th frame has a first polarity, the pixel voltage of the first pixel during a K-th frame, which is a frame within the first period and which is different from the I-th frame, has a second polarity, which is different from the first polarity, a pixel voltage of the second pixel during an L-th frame, which is a frame within the second period and which is different from the J-th frame, has the first polarity, and the pixel voltage of the second pixel during the J-th frame has the second polarity, the method comprising the steps of:

in a case where data of a first gray level as the certain gray level is to be displayed by the first and second pixels for the predetermined period, supplying a source voltage having a voltage of VA to the first pixel during the I-th frame;

supplying a source voltage having a voltage of VB to the second pixel during the J-th frame;

in a case where data of a second gray level as the certain gray level is to be displayed by the first and second pixels for the predetermined period, supplying a source voltage having a voltage of VA' to the second pixel during the L-th frame; and supplying a source voltage having a voltage of VC to the first pixel during the K-th frame, wherein:

in a case where VA=VA' for the first gray level and the second gray level, VB>VC.

21. The method according to claim 20, wherein:

the luminance of the first pixel during the I-th frame within the first period is larger than the luminance of the first pixel during a frame immediately preceding the I-th frame; and the luminance of the second pixel during the J-th frame within the second period is larger than the luminance of the second pixel during a frame immediately preceding the J-th frame.

22. The method according to claim 20, wherein:

the first polarity is a positive polarity; and in the case where VA=VA' for the first gray level and the second gray level, the second gray level is higher than the first gray level.

23. A method for driving a normally white liquid crystal display device, wherein:

when data of a certain gray level is to be displayed individually by each of a first pixel and a second pixel for a predetermined period, a luminance of each of the first and second pixels changes, the luminance of each of the first and second pixels changes in a cycle of N frames (where N is an even number of 4 or greater), the N frames include a first period and a second period, the luminance of the first pixel during the first period is smaller than the luminance of the first pixel during the second period, the luminance of the second pixel during the first period is larger than the luminance of the second pixel during the second period, an initial frame within the first period is an I-th frame, an initial frame within the second period is a J-th frame, a pixel voltage of the first pixel during the I-th frame has a first polarity, the pixel voltage of the first pixel during a K-th frame, which is a frame within the first period and which is different from the I-th frame, has a second polarity, which is different from the first polarity, a pixel voltage of the second pixel during an L-th frame, which is a frame within the second period and which is different from the J-th frame, has the first polarity, and the pixel voltage of the second pixel during the J-th frame has the second polarity, the method comprising the steps of:

in a case where data of a first gray level as the certain gray level is to be displayed by the first and second pixels for the predetermined period, supplying a source voltage having a voltage of VA to the first pixel during the I-th frame;

supplying a source voltage having a voltage of VB to the second pixel during the J-th frame;

in a case where data of a second gray level as the certain gray level is to be displayed by the first and second pixels for the predetermined period, supplying a source voltage having a voltage of VA' to the second pixel during the L-th frame; and supplying a source voltage having a voltage of VC to the first pixel during the K-th frame, wherein:

in a case where VA=VA' for the first gray level and the second gray level, VB>VC.

24. The method according to claim 23, wherein:

the luminance of the first pixel during the I-th frame within the first period is smaller than the luminance of the first pixel during a frame immediately preceding the I-th frame; and the luminance of the second pixel during the J-th frame within the second period is smaller than the luminance of the second pixel during a frame immediately preceding the J-th frame.

25. The method according to claim 23, wherein:

the first polarity is a positive polarity; and in the case where VA=VA' for the first gray level and the second gray level, the first gray level is higher than the second gray level.

26. A method for driving a liquid crystal display device, wherein:

when data of a certain gray level is to be displayed individually by each of a first pixel and a second pixel for a predetermined period, an effective value of a pixel voltage of each of the first and second pixels changes periodically, the effective value of the pixel voltage of the first pixel during an I-th frame is larger than the effective value of the pixel voltage of the first pixel during a frame immediately preceding the I-th frame, the effective value of the pixel voltage of the first pixel during a J-th frame is smaller than the effective value of the pixel voltage of the first pixel during a frame immediately preceding the J-th frame, the effective value of the pixel voltage of the second pixel during the I-th frame is larger than the effective value of the pixel voltage of the second pixel during the frame immediately preceding the I-th frame, the effective value of the pixel voltage of the second pixel during the J-th frame is smaller than the effective value of the pixel voltage of the second pixel during the frame immediately preceding the J-th frame, the pixel voltage of the first pixel during the I-th frame has a first polarity, the pixel voltage of the first pixel during the J-th frame has the first polarity, the pixel voltage of the second pixel during the I-th frame has a second polarity, which is different from the first polarity, and the pixel voltage of the second pixel during the J-th frame has the second polarity, the method comprising the steps of:

in a case where data of a first gray level as the certain gray level is to be displayed by the first and second pixels for the predetermined period, supplying a source voltage having a voltage of VA to the first pixel during the I-th frame;

supplying a source voltage having a voltage of VB to the second pixel during the I-th frame;

in a case where data of a second gray level as the certain gray level is to be displayed by the first and second pixels for the predetermined period, supplying a source voltage having a voltage of VA' to the first pixel during the J-th frame; and supplying a source voltage having a voltage of VC to the second pixel during the J-th frame, wherein:

in a case where VA=VA' for the first gray level and the second gray level, VB>VC.

27. A method for driving a normally black liquid crystal display device, wherein:

when data of a certain gray level is to be displayed individually by each of a first pixel and a second pixel for a predetermined period, a luminance of each of the first and second pixels changes periodically, the luminance of the first pixel during an I-th frame is larger than the luminance of the first pixel during a frame immediately preceding the I-th frame, the luminance of the first pixel during a J-th frame is smaller than the luminance of the first pixel during a frame immediately preceding the J-th frame, the luminance of the second pixel during the I-th frame is larger than the luminance of the second pixel during the frame immediately preceding the I-th frame, the luminance of the second pixel during the J-th frame is smaller than the luminance of the second pixel during the frame immediately preceding the J-th frame, a pixel voltage of the first pixel during the I-th frame has a first polarity, the pixel voltage of the first pixel during the J-th frame has the first polarity, a pixel voltage of the second pixel during the I-th frame has a second polarity, which is different from the first polarity, and the pixel voltage of the second pixel during the J-th frame has the second polarity, the method comprising the steps of:

in a case where data of a first gray level as the certain gray level is to be displayed by the first and second pixels for the predetermined period, supply a source voltage having a voltage of VA to the first pixel during the I-th frame;

supply a source voltage having a voltage of VB to the second pixel during the I-th frame;

in a case where data of a second gray level as the certain gray level is to be displayed by the first and second pixels for the predetermined period, supply a source voltage having a voltage of VA' to the first pixel during the J-th frame; and supply a source voltage having a voltage of VC to the second pixel during the J-th frame, wherein:

in a case where VA=VA' for the first gray level and the second gray level, VB>VC.

28. The method according to claim 27, wherein:

the first polarity is a positive polarity; and in the case where VA=VA' for the first gray level and the second gray level, the second gray level is higher than the first gray level.

29. A method for driving a normally white liquid crystal display device, wherein:

when data of a certain gray level is to be displayed individually by each of a first pixel and a second pixel for a predetermined period, a luminance of each of the first and second pixels changes periodically, the luminance of the first pixel during an I-th frame is smaller than the luminance of the first pixel during a frame immediately preceding the I-th frame, the luminance of the first pixel during a J-th frame is larger than the luminance of the first pixel during a frame immediately preceding the J-th frame, the luminance of the second pixel during the I-th frame is smaller than the luminance of the second pixel during the frame immediately preceding the I-th frame, the luminance of the second pixel during the J-th frame is larger than the luminance of the second pixel during the frame immediately preceding the J-th frame, a pixel voltage of the first pixel during the I-th frame has a first polarity, the pixel voltage of the first pixel during the J-th frame has the first polarity, a pixel voltage of the second pixel during the I-th frame has a second polarity, which is different from the first polarity, and the pixel voltage of the second pixel during the J-th frame has the second polarity, the method comprising the steps of:

in a case where data of a first gray level as the certain gray level is to be displayed by the first and second pixels for the predetermined period, supplying a source voltage having a voltage of VA to the first pixel during the I-th frame;

supplying a source voltage having a voltage of VB to the second pixel during the I-th frame;

in a case where data of a second gray level as the certain gray level is to be displayed by the first and second pixels for the predetermined period, supplying a source voltage having a voltage of VA' to the first pixel during the J-th frame; and supplying a source voltage having a voltage of VC to the second pixel during the J-th frame, wherein:

in a case where VA=VA' for the first gray level and the second gray level, VB>VC.

30. The method according to claim 29, wherein:

the first polarity is a positive polarity; and in the case where VA=VA' for the first gray level and the second gray level, the first gray level is higher than the second gray level.

* * * * *